US010066903B2

(12) United States Patent
Crispin

(10) Patent No.: US 10,066,903 B2
(45) Date of Patent: Sep. 4, 2018

(54) HIGH-ANGLE SIGHT MOUNT

(71) Applicant: LEUPOLD & STEVENS, INC., Beaverton, OR (US)

(72) Inventor: Quint Crispin, Beaverton, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 15/264,477

(22) Filed: Sep. 13, 2016

(65) Prior Publication Data

US 2018/0073839 A1 Mar. 15, 2018

(51) Int. Cl.

| | |
|---|---|
| ***F41G 1/00*** | (2006.01) |
| ***F41G 11/00*** | (2006.01) |
| ***F41G 1/48*** | (2006.01) |
| ***F41G 1/54*** | (2006.01) |

(52) U.S. Cl.

CPC ..... *F41G 11/001* (2013.01); *F41G 1/48* (2013.01); *F41G 1/545* (2013.01); *F41G 11/003* (2013.01)

(58) Field of Classification Search

CPC ..... F41G 1/28; F41G 1/16; F41G 1/30; F41G 11/001; F41G 11/003

USPC ..... 42/125–137

See application file for complete search history.

(56) References Cited

U.S. PATENT DOCUMENTS

RE14,009 E * 11/1915 Warner ..... F41G 1/28 33/38
1,206,060 A * 11/1916 Warner ..... F41G 1/28 42/136
2,155,391 A * 4/1939 Arden ..... F41G 1/28 42/125
2,345,553 A * 4/1944 Brown ..... F41G 1/28 42/136
2,548,031 A * 4/1951 Leupold ..... F41G 11/001 403/188
2,576,347 A * 11/1951 Jones ..... F41G 11/001 42/125
2,774,143 A * 12/1956 Sunderland ..... F41G 1/26 42/137
3,414,221 A * 12/1968 Nelson ..... F41G 11/001 248/316.5
3,792,534 A * 2/1974 Lowe, Jr. ..... F41G 1/28 42/137
3,882,609 A * 5/1975 Troutman ..... F41G 1/28 42/124
4,127,943 A * 12/1978 Tiritilli ..... F41G 1/28 42/138
4,317,304 A * 3/1982 Bass ..... F41G 11/001 42/125
4,742,636 A * 5/1988 Swan ..... F41G 11/006 42/126
5,638,604 A * 6/1997 Lorocco ..... F41G 1/345 42/126

(Continued)

*Primary Examiner* — Michael D David

(74) *Attorney, Agent, or Firm* — McCoy Russell LLP

(57) ABSTRACT

Methods and systems are provided for a high-angle sight mount for a projectile launcher. In one example, a system for a sight mount may include a base, a cartridge configured with a quick-release element and adapted for insertion into a cylindrical chamber coupled to the base, and a plurality of cams coupled to the cartridge and adapted to engage with a surface of the mounting platform of the sight mount to adjust an angle of a mounting platform relative to the base.

19 Claims, 12 Drawing Sheets

(56) References Cited

U.S. PATENT DOCUMENTS

| | | | | |
|---|---|---|---|---|
| 6,779,290 | B1 * | 8/2004 | Houtsma | F41G 1/08 42/111 |
| 7,225,577 | B1 * | 6/2007 | Wang | F41G 11/003 42/124 |
| 7,543,405 | B1 * | 6/2009 | Ivey | F41G 11/003 42/125 |
| 7,647,720 | B1 * | 1/2010 | Vendetti | F41G 1/28 42/126 |
| 8,151,509 | B2 * | 4/2012 | Rozitis | F41G 11/003 42/125 |
| 8,156,678 | B2 * | 4/2012 | Hoel | F41G 11/003 42/124 |
| 8,240,075 | B1 * | 8/2012 | Mullin | F41G 11/003 42/119 |
| 8,407,924 | B2 | 4/2013 | Lee et al. | |
| 9,057,584 | B2 * | 6/2015 | Chung | F41G 1/16 |
| 9,383,167 | B1 * | 7/2016 | Connolly | F41G 11/003 |
| 9,714,814 | B2 * | 7/2017 | Dentler | F41G 11/004 |
| 9,823,045 | B2 * | 11/2017 | Chu | F41B 5/12 |
| 2006/0010759 | A1 * | 1/2006 | Penney | F41G 11/001 42/126 |
| 2007/0199227 | A1 * | 8/2007 | Ertl | F41G 1/10 42/137 |
| 2010/0162611 | A1 * | 7/2010 | Samson | F41G 1/18 42/125 |
| 2011/0154713 | A1 * | 6/2011 | Jung | F41G 1/30 42/137 |
| 2015/0198421 | A1 | 7/2015 | Crispin | |

* cited by examiner

HIGH-ANGLE SIGHT MOUNT

FIELD

The present description relates generally to methods and systems for a high-angle sight mount for a projectile launcher.

BACKGROUND/SUMMARY

A system for adjusting a trajectory of a projectile fired from a projectile launcher, for example a hand-held firearm or a mounted grappling hook launcher, may include a sight adapted to align a firing direction of the projectile launcher with a target. A range selector may be configured to adjust a vertical component (e.g., a direction along an axis parallel to a direction of gravity) of the firing direction in order to adjust an arc of the projectile toward the target. For example, a trajectory of a projectile fired from a launcher may change over time due to external forces such as gravity, friction (e.g., air resistance), etc. as the projectile travels toward the target. Accordingly, the range selector may be used to adjust a firing direction in order to arc the projectile more accurately towards the target.

One example approach of a system for adjusting a trajectory of a projectile is shown by Lee et al. in U.S. Pat. No. 8,407,924. Therein, a trajectory correcting unit is disclosed which may be fastened to a firearm via a gun barrel supporter. The trajectory correcting unit includes an optical sight mounted to a base of the unit, with an angle of the base (and therefore, the optical sight) relative to the firearm adjustable via a plurality of polygonal cams coupled to a rotary shaft. A stopper is fastened (e.g., by a bolt) to the trajectory correcting unit in order to lock a selected cam of the plurality of polygonal cams into engagement with a contact unit of the base. Each polygonal cam includes a plurality of surfaces configured to engage with the contact unit and to angle the base relative to the gun barrel supporter by different amounts. By angling the base relative to the gun barrel supporter, an angle of the optical sight relative to the firearm may be increased or decreased, and a trajectory of a projectile fired from the firearm may be adjusted.

However, the inventors herein have recognized potential issues with such systems. As one example, such systems may not be configured to adjust a trajectory of a projectile larger than a bullet, such as a grenade. Larger projectiles may have an increased mass relative to a bullet and may be fired at a lower relative velocity. The decreased velocity may result in an increased amount of time that the projectile is airborne, thereby increasing an amount of time that the projectile is subject to the external forces described above. This may result in a relatively large change in trajectory of the larger projectile when compared to a change in trajectory of a bullet. Accordingly, the polygonal cams described above may not provide a large enough angle between the optical sight and the firearm to arc the larger projectile towards a target.

As another example, while each cam of the plurality of polygonal cams may include a different arrangement and/or number of surfaces in order to adjust a trajectory for different conditions (e.g., with a different type of bullet, different elevation, etc.), an amount of time to switch between cams may be increased according to the trajectory correcting unit described above. For example, in order to switch from a first cam to a second cam, the stopper is unfastened from a first side of the trajectory correcting unit (e.g., by unfastening a fastening member coupled to the stopper, such as a bolt), the rotary shaft is moved to engage the second cam with the contact unit, and the stopper is re-fastened to a second (e.g., opposite) side of the trajectory correcting unit. Removing and replacing the stopper may increase an amount of time to change from the first cam to the second cam, and may additionally increase an amount of tools used to reposition the cams of the trajectory correcting unit (e.g., by utilizing a separate tool to remove the fastening member of the stopper).

In one example, the issues described above may be at least partially addressed by a method for an article of manufacture, comprising: a base having a cylindrical opening; a cartridge rotatably mounted in the cylindrical opening and having a quick-release element and a cam surface; and a pivoting sight mount surface engaging the cam surface. In this way, a quick selection between a plurality of cams is enabled in order to adjust a trajectory of a projectile without the use of tools.

As one example, the quick-release element includes an unlock button positioned at a first side of the cartridge, and the sight mount surface is additionally coupled to a bubble level in order to indicate a tilt amount of the sight mount surface. A second side of the cartridge, opposite to the first side, includes a plurality of cams positioned coaxially relative to each other and radially offset from a central axis of the cartridge. Each cam of the plurality of cams includes a single flat surface, and each cam includes a different, continuously curved surface coupled to the corresponding single flat surface. The engagement of the continuously curved surface of each cam with the sight mount surface defines an angle of the sight mount surface relative to the base. Adjusting an engagement position of the selected cam with the sight mount surface also adjusts an angle of a sight (e.g., an optical dot sight) coupled to the sight mount surface, and a trajectory of a projectile fired from a device (such as a grenade launcher) coupled to the article of manufacture (which may herein be referred to as a high-angle sight mount) may be corrected.

By utilizing the quick-release element of the cartridge, an operator of the high-angle sight mount may quickly remove and replace one cartridge including a first plurality of cams with another cartridge including a different, second plurality of cams. Each plurality of cams may be configured for a separate set of conditions, such as projectile type, environmental conditions, elevation, etc., enabling the operator to quickly respond to changes in conditions by changing cartridges without the use of tools (for example, changing from a cartridge with cams configured for one projectile type, to a cartridge with cams configured for a different projectile type). The operator may also choose which cam of the cartridge is in engagement with the sight mount surface by sliding the cartridge along the cartridge central axis within the cylindrical opening. In this way, a single cartridge may include cams configured for several conditions (such as those described above), enabling the operator to select an appropriate cam without disengaging the cartridge from the cylindrical opening and without using tools.

Additionally, by offsetting the position of each cam relative to the central axis of the cartridge, the selected cam may rotate the sight mount surface through an increased angular range. As a result, the angle of the optical sight relative to the base may be increased, thereby increasing an arcing distance of a projectile fired from a device to which the high-angle sight mount is mounted. In this way, the high-angle sight mount may adjust trajectories for an increased amount of projectile types, including projectiles larger than bullets. The bubble level may be configured to adjust for a spin drift of such a projectile (in one example, a grenade) due to external forces on the projectile (e.g., gravity, air resistance, etc.).

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-12 are shown to scale, though other relative dimensions may be used.

DETAILED DESCRIPTION

Figure 1:
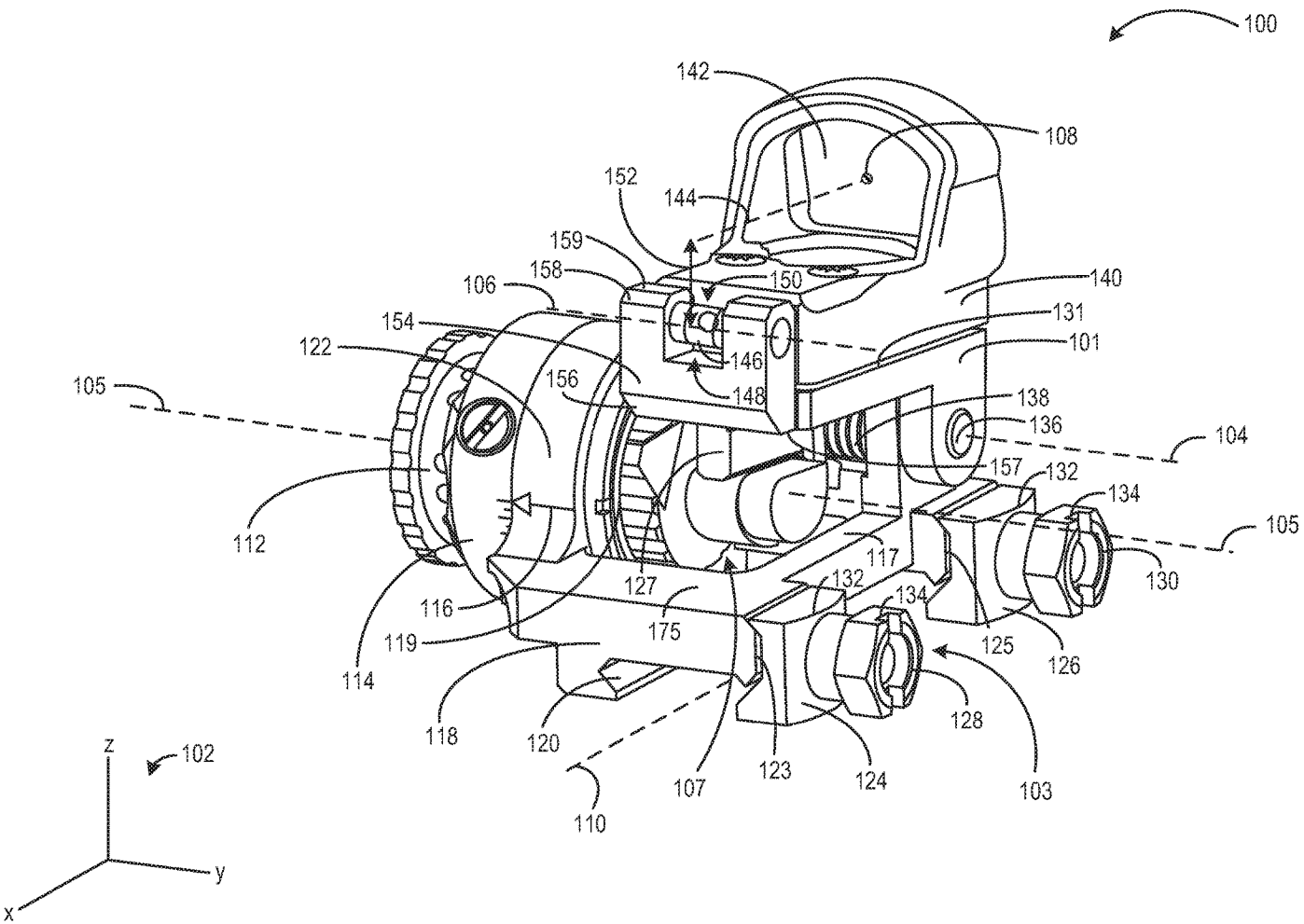
FIG. 1 shows a first perspective view of an embodiment of a high-angle sight mount, including a sight coupled to a mounting platform of the sight mount.
Figure 2:
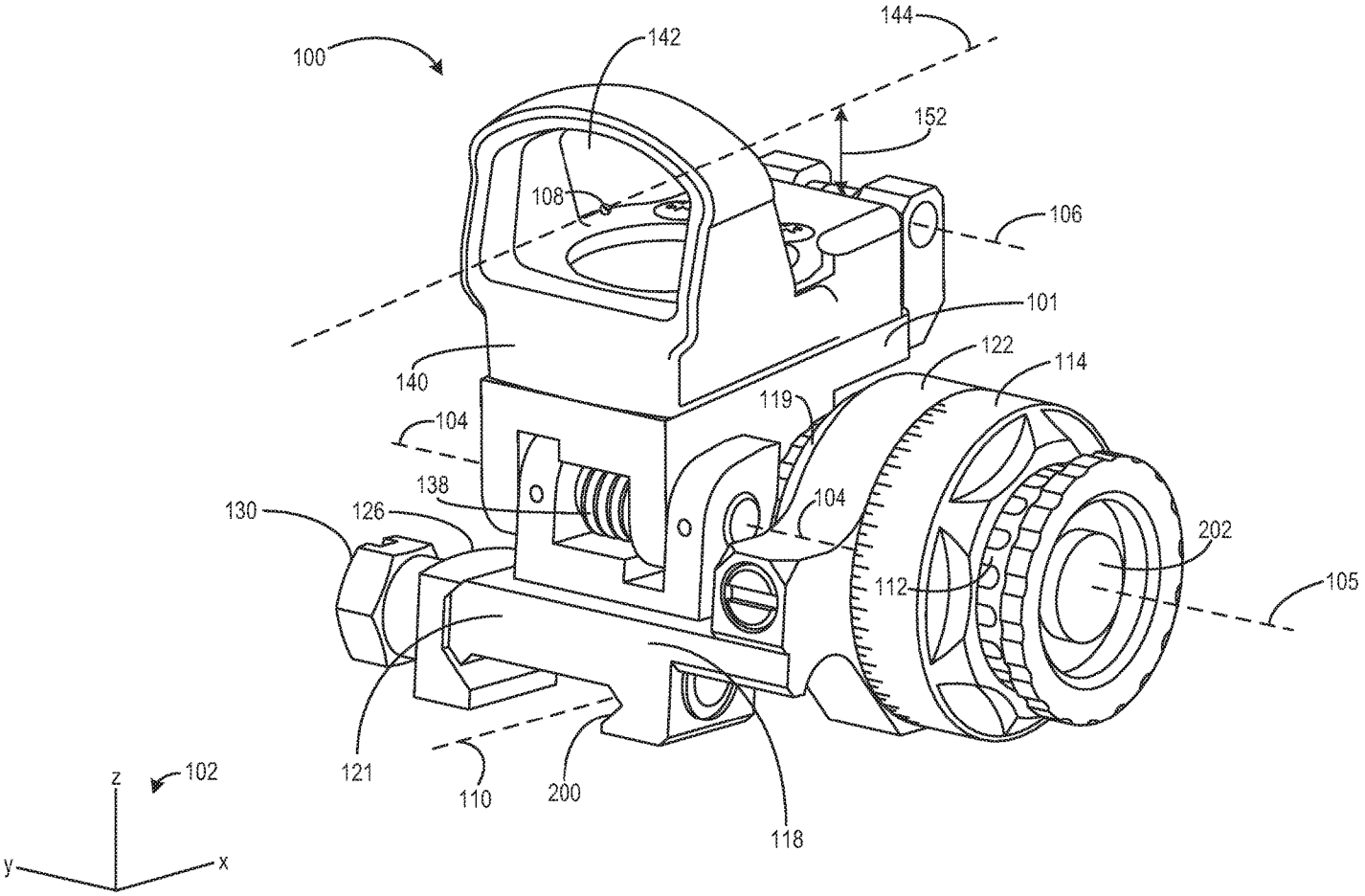
FIG. 2 shows a second perspective view, opposite to the first perspective view shown by FIG. 1, of the embodiment of the high-angle sight mount.
Figure 5:
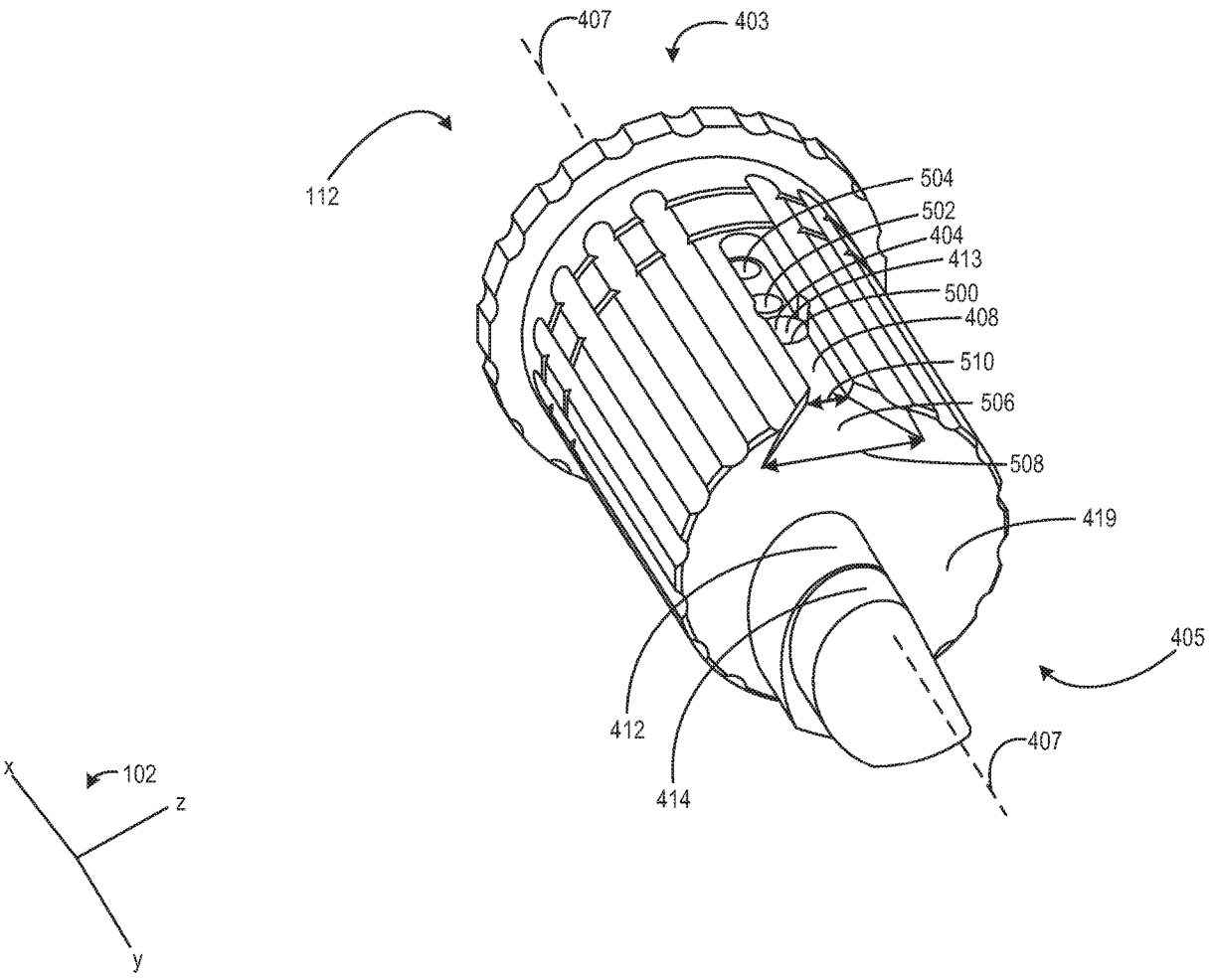
FIG. 5 shows a second perspective view of the cartridge, with the locking pin in an unlocked position.
Figure 6:
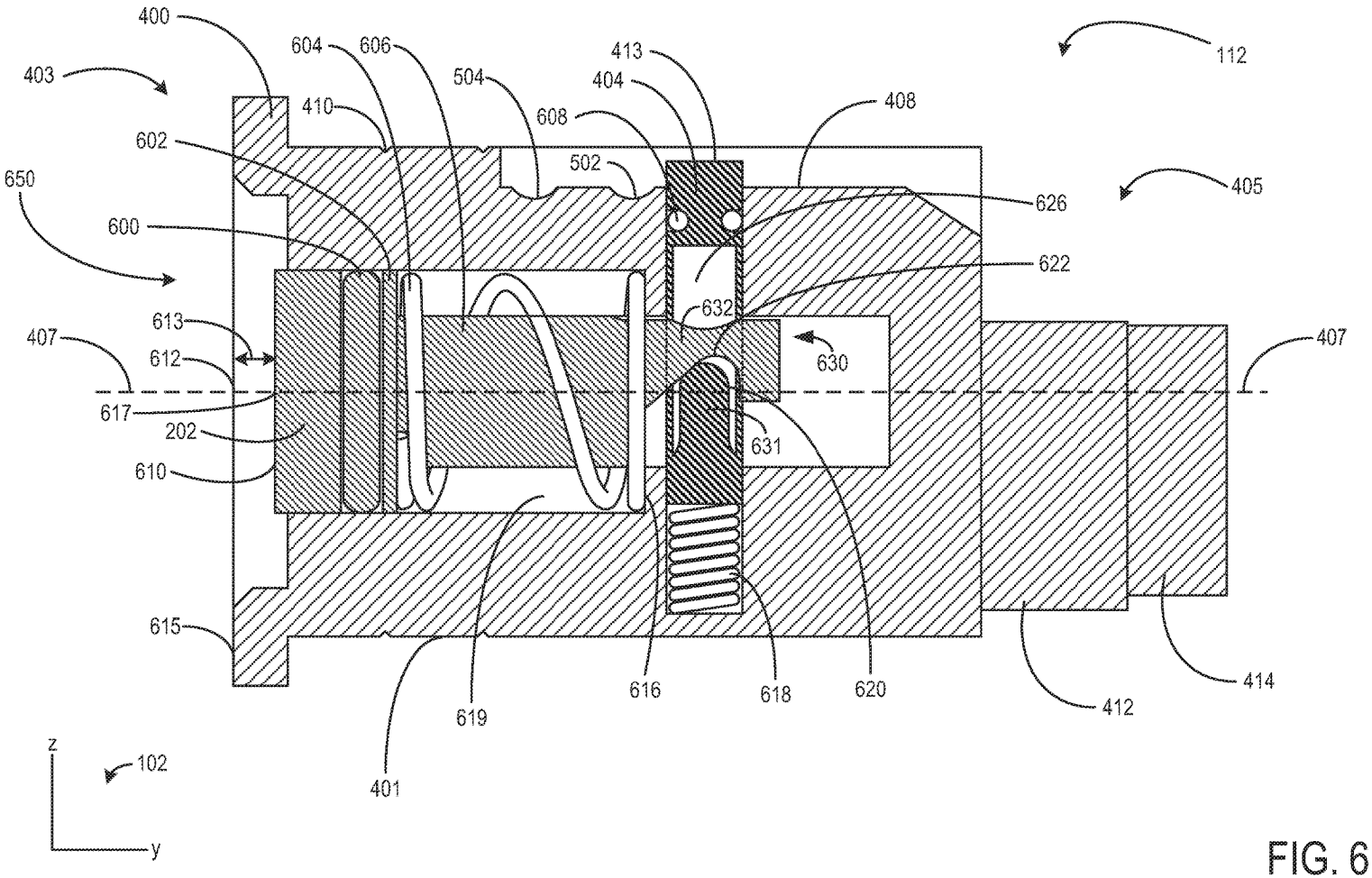
FIG. 6 shows a cross-sectional view of the cartridge, depicting a quick-release element of the cartridge.
Figure 7:
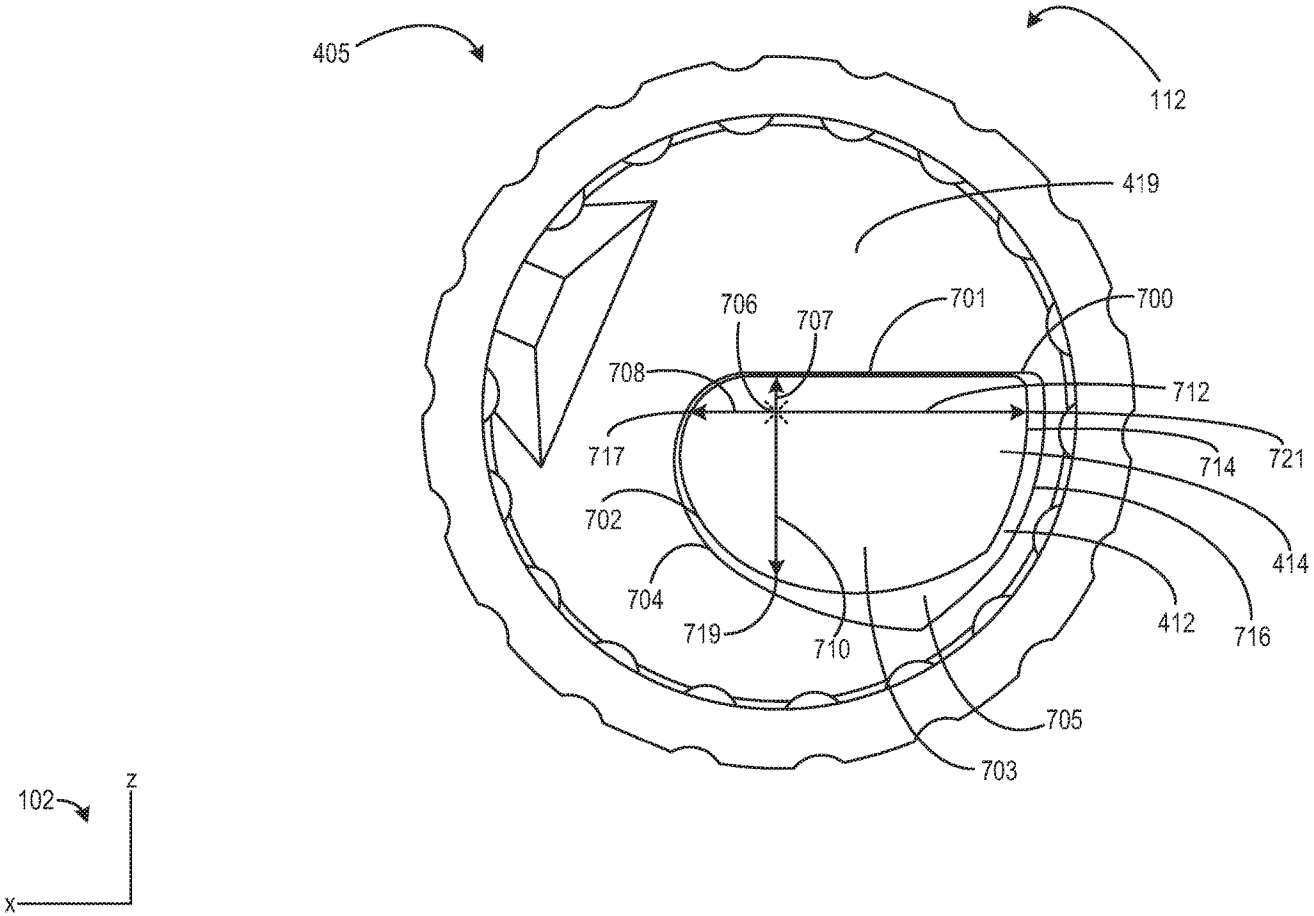
FIG. 7 shows a first profile view of an end of the cartridge, with a plurality of cams coupled to the end.
Figure 8:
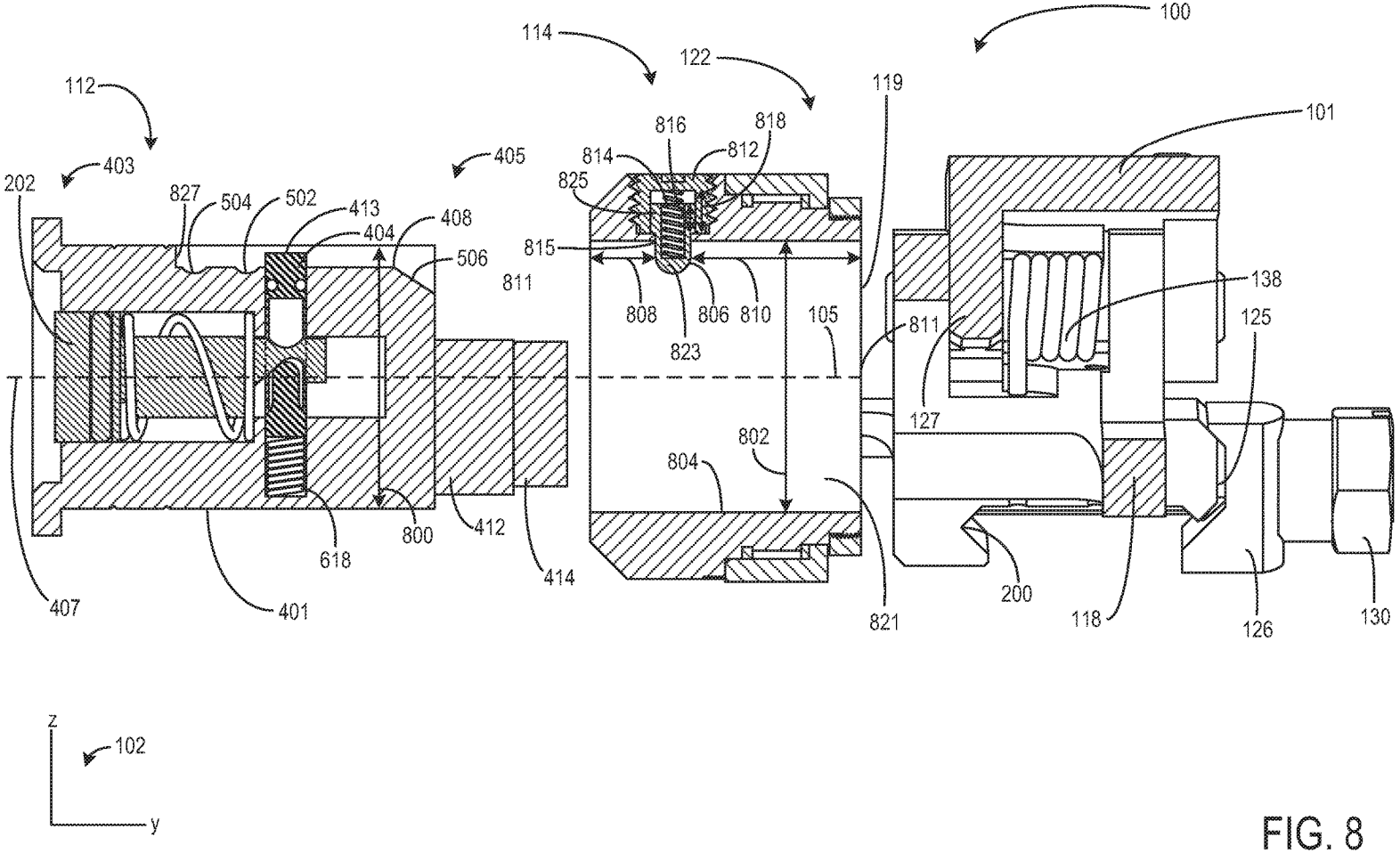
FIG. 8 shows a cross-sectional view of the high-angle sight mount, with the cartridge shown decoupled from the high-angle sight mount.
Figure 9:
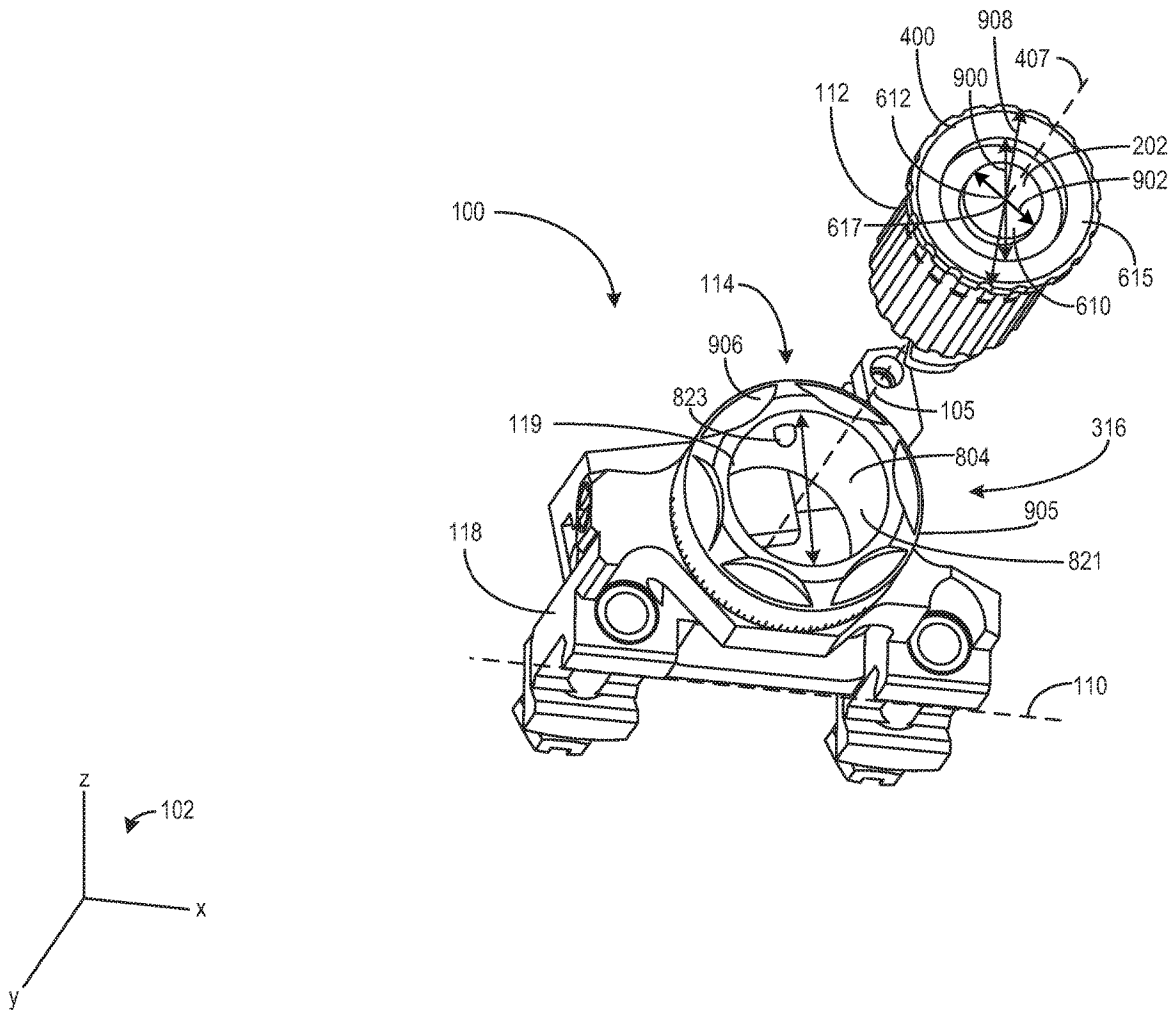
FIG. 9 shows a perspective view of the high-angle sight mount, with the cartridge shown decoupled from the high-angle sight mount.
Figure 10:
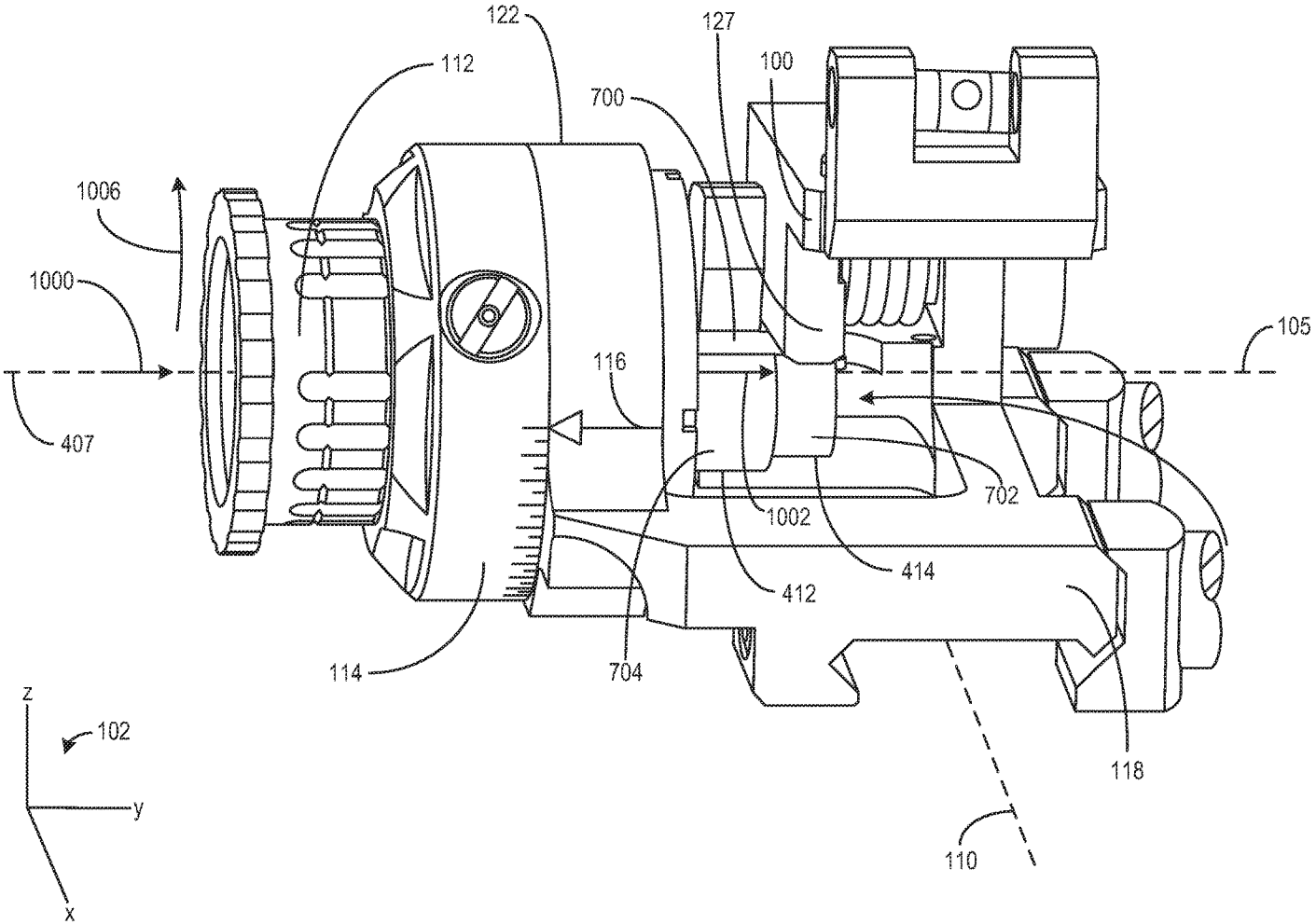
FIG. 10 shows a perspective view of the cartridge in engagement with the high-angle sight mount, with the cartridge in a reference position.
Figure 11:
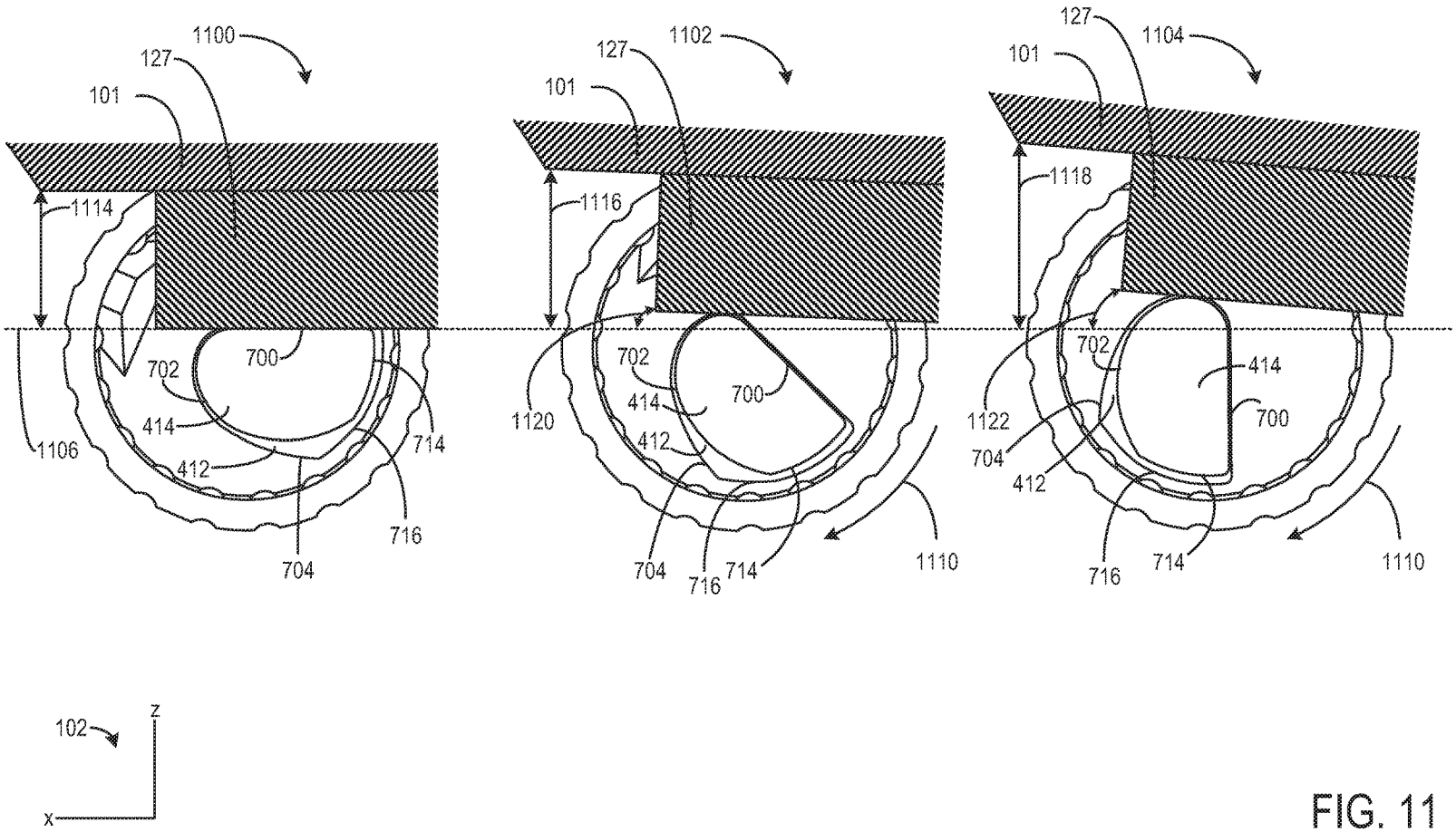
FIG. 11 shows a profile view of the cartridge in engagement with a surface of the mounting platform of the high-angle sight mount, with the cartridge rotated into three different positions relative to the reference position.
Figure 12:
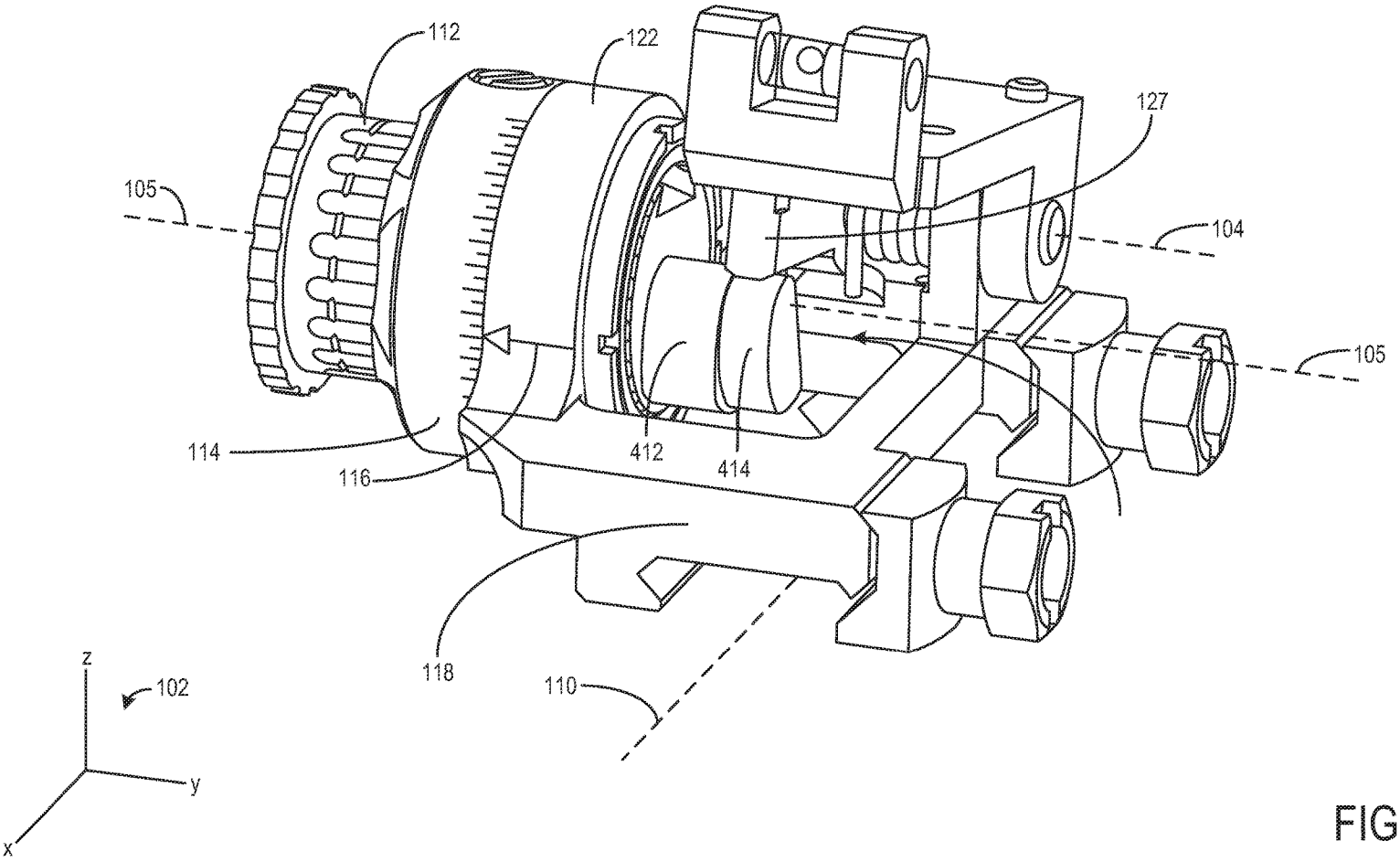
FIG. 12 shows a perspective view of the cartridge in engagement with the high-angle sight mount, with the cartridge rotated at an angle relative to the reference position.

The following description relates to systems and methods for a high-angle sight mount for a projectile launcher. A high-angle sight mount, such as the high-angle sight mount shown by FIG. 1, includes a base, a cylindrical opening adapted to couple with a removable cartridge, and a pivotable sight mounting platform. The sight mounting platform is coupled to a bubble level, with the bubble level positioned below a viewing aperture of a sight coupled to the platform, as shown by FIGS. 1-2. The sight mounting platform includes a plurality of biasing elements, such as the biasing elements shown by FIG. 3, adapted to stabilize the sight on the sight mounting platform. The cartridge includes a locking pin, such as the locking pin shown by FIG. 4, positioned within an indented surface along an exterior surface of the cartridge and is configured to lock the cartridge into the cylindrical chamber. The cartridge also includes a plurality of grooves along the exterior surface, as shown by FIG. 5, to reduce a likelihood of the cartridge becoming trapped within the cylindrical opening. The locking pin is moveable into a plurality of positions between fully extended and fully retracted, and is biased into the fully extended position by a biasing element positioned within an interior of the cartridge, as shown by FIG. 6. An unlock button positioned at a first end of the cartridge may be actuated to retract the locking pin. Together, the unlock button and locking pin form one embodiment of a quick-release element of the cartridge. A second end of the cartridge includes a plurality of cams, and each cam includes a different continuously curved surface coupled to at least one corresponding flat surface of the plurality of cams, as shown by FIG. 7. The cartridge is inserted into the cylindrical chamber and may slide from one position to another along a central axis of the chamber, with each position corresponding to engagement of a biasing member within the chamber with a different detent of the cartridge, as shown by FIG. 8. As such, the cartridge is inserted into the high-angle sight mount from a single side of the high-angle sight mount, as shown by FIG. 9. Each flat surface of the plurality of cams designates a different reference position of the sight mounting platform when the platform is in engagement with one of the flat surfaces, as shown by FIG. 10. The cartridge may then be rotated into a plurality of positions, as shown by FIG. 11, to increase or decrease an angle of the sight mounting platform relative to the base, as shown by FIG. 12. In this way, a trajectory of a projectile fired from the projectile launcher may be adjusted by the high-angle sight mount to align a location of impact of the projectile with a target viewed through the viewing aperture of the sight.

FIGS. 1-12 each show a same embodiment of a system for a high-angle sight mount (and components of the system) from different perspectives and cross-sectional views. For example, FIGS. 1-2 show the high-angle sight mount with an optical dot sight coupled to a mounting surface of the high-angle sight mount, while FIG. 3, FIGS. 8-10, and FIG. 12 each show the high-angle sight mount with the optical dot sight removed. The optical dot sight is shown for illustrative purposes to demonstrate a relative position of components of the high-angle sight mount. As such, the high-angle sight mount may be utilized with (e.g., coupled to) any appropriate sight (e.g., iron sights, laser sights, telescopic sights, etc.). Reference axes 102 are included in each of FIGS. 1-12 in order to compare each of the views shown.

FIGS. 1-2 each show a perspective view of a high-angle sight mount 100, including a base 118, a pivotable sight mount surface 101, a cylindrical opening 119 formed by an annular portion 122 of the base 118, and a cartridge 112 configured for insertion into the cylindrical opening 119. The high-angle sight mount 100 additionally includes a range selector dial 114 rotatably coupled to the annular portion 122 of the base 118, with a range indicator 116 positioned on the annular portion 122 to indicate a selected range on the range selector dial 114. The pivotable sight mount surface 101 (which may herein be referred to as platform 101) is coupled to the base 118 by a pivot pin 136 and is urged in a direction towards the base 118 by a biasing member 138 (e.g., a spring). The platform 101 is pivotable about a pivot axis 104 positioned parallel to a longest length of the pivot pin 136, such that the platform 101 may pivot toward or away from the base 118. The platform 101 is adapted to couple to a sight, such as optical dot sight 140.

The optical dot sight 140 shown by FIGS. 1-2 includes a viewing aperture 142 formed from a transparent material (e.g., glass, plastic, etc.) and an aiming dot 108 (e.g., reticle) projected onto the viewing aperture by the optical dot sight 140.

The base 118 of the high-angle sight mount 100 includes a plurality of mounting grooves adapted to mount the high-angle sight mount 100 to a projectile launcher. In one example, the projectile launcher may be a grenade launcher configured to fire various types of grenades (e.g., explosive grenades, gas grenades, etc.). In another example, the projectile launcher may be a grappling hook launcher, t-shirt launcher, soda can launcher, or other type of launcher for a different type of projectile. The base 118 includes a first mounting groove 120 (shown by FIG. 1) and a second mounting groove 200 (shown by FIG. 2) positioned along a bottom of the base. The first mounting groove 120 and second mounting groove 200 are configured to directly couple to (e.g., be in face-sharing contact with) a first side of a mounting rail of a projectile launcher (not shown). In one example, the mounting rail may be positioned along a top of the projectile launcher relative to a projectile loading chamber of the projectile launcher. The high-angle sight mount 100 also includes a first mounting bracket 124 adapted to couple to the base 118 at a first location 123 opposite to the first mounting groove 120, and a second mounting bracket 126 adapted to couple to the base 118 at a second location 125 opposite the second mounting groove 200. The first mounting bracket 124 and second mounting bracket 126 are each configured to directly couple with a second side (opposite to the first side) of the mounting rail when a first fastener 128 couples the first mounting bracket 124 to the first location 123 of the base 118, and a second fastener 130 couples the second mounting bracket 126 to the second location 125 of the base 118. In this way, a mounting axis 110 (e.g., an axis along which the high-angle sight mount 100 is coupled to the projectile launcher) of the high-angle sight mount 100 is parallel to a central axis (e.g., an axis centered within the projectile loading chamber and parallel to a longest length of the projectile launcher) of the projectile launcher. In one example, each of the first fastener 128 and the second fastener 130 include a groove 134 and may engage or disengage the corresponding mounting bracket from the base 118 by rotation (e.g., by a tool, such as a screwdriver, socket wrench, etc., or by hand). Each of the first mounting bracket 124 and second mounting bracket 126 include a curved surface 132 positioned outward from the base 118 (e.g., curving away from the base 118 when the brackets are coupled to the base) in order to increase a durability of each mounting bracket (e.g., a resistance to crushing, bending, etc.).

By coupling the high-angle sight mount 100 to the projectile launcher at two locations as described above, the high-angle sight mount 100 is securely mounted along the mounting axis 110 in a non-pivoting configuration. In other words, while other components of the high-angle sight mount 100 may pivot (such as the platform 101, as described below), the base 118 of the high-angle sight mount 100 is locked into position along the mounting axis 110. Therefore, the base 118 may herein be described as being in a "stationary" or "fixed" position relative to other components of the high-angle sight mount 100. A first space 103 is formed between each of the two locations and around the base 118. As a result, a likelihood of environmental debris (e.g., sand, dirt, water, etc.) becoming trapped along the base 118 between the two locations may be reduced, and an overall mass of the high-angle sight mount 100 is decreased.

In addition to the first space 103 formed between the first mounting bracket 124 at the first location 123 and the second mounting bracket 126 at the second location 125, a second space 107 is formed between the surfaces of the base 118 and the cylindrical opening 119. Specifically, the base 118 includes a first portion 175 extending in a direction perpendicular to the mounting axis 110 (and parallel to the y-axis shown by reference axes 102), a second portion 117 extending parallel to the mounting axis 110, and a third portion 121 (shown by FIG. 2) extending perpendicular to the mounting axis 110 and parallel to the first portion 175. The first portion 175 couples to the second portion 117, and the second portion 117 couples to the third portion 121, such that the second portion 117 extends between the first portion 175 and the third portion 121 in a direction parallel to the mounting axis 110. Additionally, the annular portion 122 couples the first portion 175 to the third portion 121 and is positioned such that a central axis 105 of the annular portion (e.g., an axis extending through a midpoint of the annular portion, as shown by FIG. 8) is arranged perpendicular to the mounting axis 110 (e.g., parallel to the y-axis shown by reference axes 102).

In this configuration, the second space 107 is formed between each of the first portion 175, second portion 117, third portion 121, and annular portion 122, and extends between the mounting rail of the projectile launcher (not shown) and a plurality of surfaces of the platform 101. For example, the platform 101 includes a protrusion 127 extending away from a bottom surface (e.g., a surface positioned parallel and opposite to a top surface 131 on which the optical dot sight sits) of the platform 101 in a direction toward the mounting rail of the projectile launcher. The second space 107 extends between the mounting rail and the bottom surface of the platform 101, with the protrusion 127 extending into the second space 107. By configuring the second space 107 to be positioned between the base 118 and the platform 101 as described above, a portion of the cartridge 112 may be inserted into the second space 107 to engage the platform 101 by actuating an unlock button 202 coupled to the cartridge 112, as described below with reference to FIGS. 8-12.

The high-angle sight mount 100 also includes a bubble level 146 coupled to the platform 101. The bubble level 146 is mounted within a bubble level bracket 154 formed by the platform 101. In one example, the bubble level 146 may be removably mounted (e.g., fastened by a removable fastener) within the bubble level bracket 154. The bubble level bracket 154 extends in a direction perpendicular to the top surface 131 and away from both of the platform 101 and the protrusion 127. The bubble level 146 is mounted within the bubble level bracket 154 such that a longest length of the bubble level 146 is positioned parallel to a leveling axis 106. The leveling axis 106 is in a position such that the bubble level 146 indicates an amount of tilt of the high-angle sight mount 100 (and therefore, the projectile launcher coupled to the high-angle sight mount 100). In other words, as the projectile launcher is rotated by an amount along its central axis, the high-angle sight mount 100 is rotated by a same amount in a same direction. A position of a bubble within the bubble level 146 indicates the amount of rotation of the projectile launcher and the high-angle sight mount 100 as described above. When the bubble of the bubble level 146 is positioned within a center of the bubble level 146 (e.g., between a pair of indicator lines of the bubble level), the projectile launcher is in a position such that an amount of distance between a target sighted through the optical dot sight 140 and an impact location of the projectile is reduced.

For example, a projectile may be urged by spin drift to travel in a direction perpendicular to the firing direction due to a spinning of the projectile. The bubble level 146 (and therefore, a position of the leveling axis 106) is configured such that centering the bubble within the bubble level 146 (e.g., by tilting the projectile launcher and high-angle sight mount 100 together in an appropriate direction around the central axis) adjusts a trajectory of the projectile to counteract spin drift. In other words, by firing the projectile from the projectile launcher while the bubble is centered within the bubble level 146, the impact location of the projectile may be adjusted in a direction opposite to a direction of spin drift of the projectile so that the impact location coincides with a target indicated by the aiming dot 108 of the optical sight 140. In this way, the high-angle sight mount 100 may increase an accuracy (e.g., an ability to hit a target with a projectile) of the projectile launcher.

The bubble level bracket 154 extends away from the platform 101 as described above such that the leveling axis 106 of the bubble level 146 is a distance 152 vertically below (e.g., relative to the platform 101) a viewing axis 144 of the viewing aperture 142. In other words, the bubble level 146 is positioned away from and below the viewing aperture 142 so as to reduce an amount of visual obstruction of the viewing aperture 142. A top surface 159 of the bubble level bracket 154 (e.g., a surface of the bubble level bracket 154 positioned furthest from the platform 101) is coupled to a first angled surface 158 positioned at an angle relative to the top surface 159. A bottom surface 157 (opposite to the top surface 159) is coupled to a second angled surface 156, with the second angled surface positioned at an angle relative to the bottom surface 157. The first angled surface 158 and second angled surface 156 reduce an edge sharpness of the bubble level bracket 154, and may reduce a likelihood of user injury in an event of projectile launcher recoil. The bubble level 146 is surrounded by a first space 150 positioned vertically above the bubble level 146 relative to the platform 101, and a second space 148 positioned vertically below the bubble level 146. The first space 150 and second space 148 may reduce a likelihood of debris accumulation (e.g., dirt, sand, etc.) between the bubble level 146 and the bubble level bracket 154.

Figure 3:
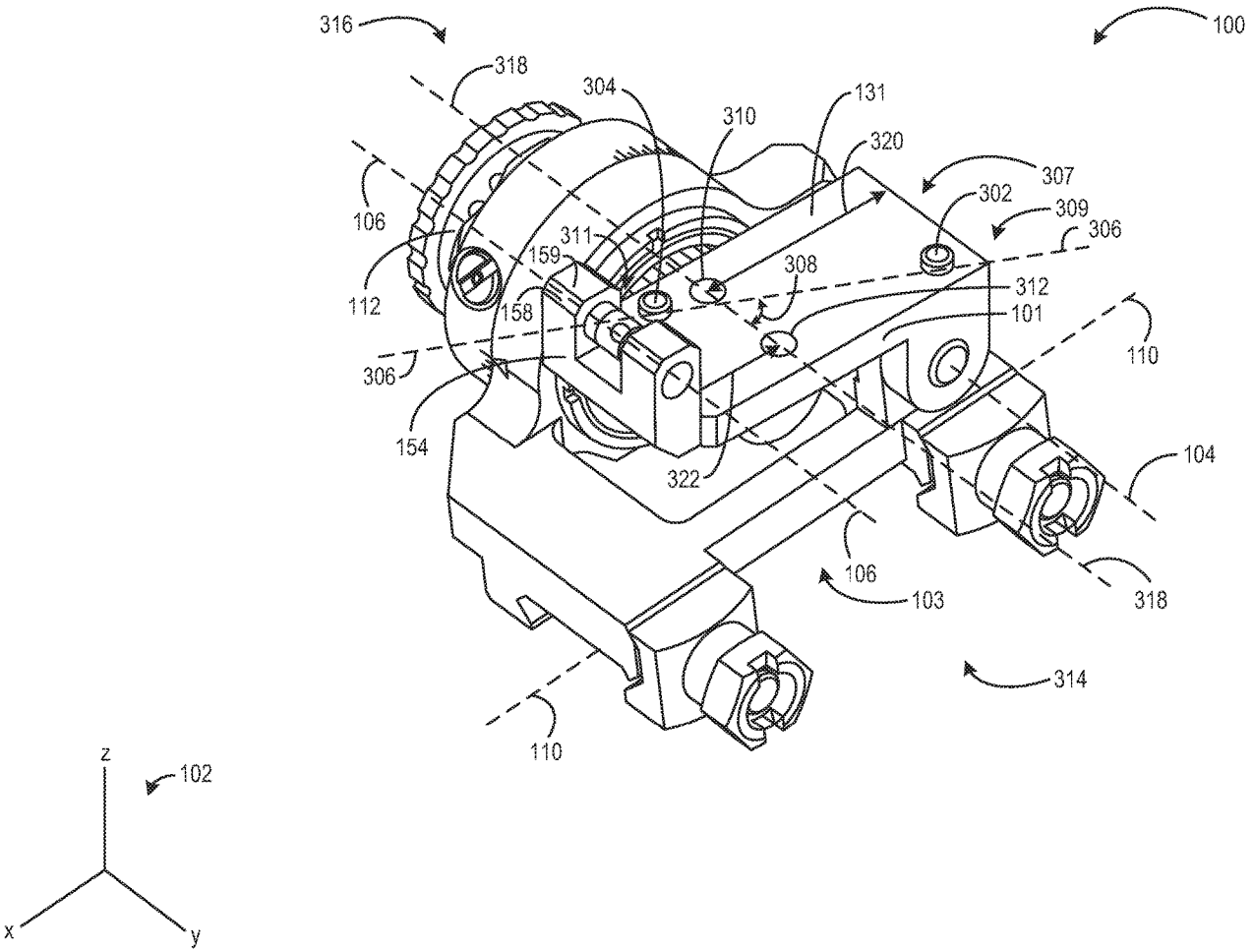
FIG. 3 shows third perspective view of the embodiment of the high-angle sight mount, with the sight removed from the mounting platform.

In order to illustrate the coupling of the optical dot sight to the platform, FIG. 3 shows a perspective view of the high-angle sight mount 100 with the optical dot sight removed (e.g., the optical dot sight 140 shown by FIGS. 1-2). The top surface 131 of the platform 101 is shown, including a first mounting hole 310 and a second mounting hole 312, each adapted to receive a fastener (e.g., a bolt). Each mounting hole may be coupled to a corresponding mounting hole of the optical dot sight, with the optical dot sight coupled to the top surface 131 by inserting fasteners through each of the mounting holes. The mounting holes of the platform 101 are positioned along a first axis 318, with the first axis 318 arranged approximately parallel to the leveling axis 106 and positioned a distance 322 from the bubble level bracket 154. The first axis 318 (and the mounting holes 310 and 312) are positioned a distance 320 from an end 307 of the platform 101, with the distance 322 being less than the distance 320. By positioning the mounting holes 310 and 312 closer to the bubble level bracket in this way, the optical dot sight may be fastened to the platform 101 at a location closer to the bubble level bracket 154, thereby reducing a likelihood of the optical dot sight slipping or becoming dislodged from the platform 101.

The platform 101 also includes a first pin 304 and a second pin 302 positioned along a second axis 306. The second axis 306 is arranged at an angle 308 relative to the first axis 318. Each of the first pin 304 and second pin 302 are coupled to the platform 101 and extend in a direction away from the platform 101 (e.g., in a direction toward the optical dot sight when the sight is coupled to the platform 101). The second axis 306 is arranged such that the first pin 304 is positioned at a first corner 309 of the platform 101 while the second pin 302 is positioned at a second corner 311 of the platform 101. By positioning the pins in this way, an alignment of the optical dot sight with the platform 101 may be increased when the sight is coupled to the platform. For example, when the optical dot sight is coupled to the platform, the first pin 304 and second pin 302 are each inserted into a corresponding opening (e.g., aperture) of a pair of openings (not shown) of the optical dot sight in order to center the sight on the platform 101. In this way, each of the pins (e.g., first pin 304 and second pin 302) may guide the optical dot sight into position on the platform 101. The optical dot sight may be secured (e.g., coupled) to the platform 101 by fasteners inserted through the first mounting hole 310 and a second mounting hole 312 as described above.

The high-angle sight mount 100 includes a first end 316 and a second end 314, with the first end 316 corresponding to an end at which the cartridge 112 is inserted into the high-angle sight mount 100, and the second end 314 opposite to the first end 316. The cartridge 112 is inserted into the high-angle sight mount 100 only from the first end 316. In other words, while the cartridge 112 may extend towards the second end 314 of the high-angle sight mount 100 when the cartridge 112 is coupled to the high-angle sight mount 100, the only point of insertion of the cartridge (e.g., a location at which a user inserts the cartridge 112) is located at the first end 316. A configuration of the cartridge 112 is described below with reference to FIG. 4.

Figure 4:
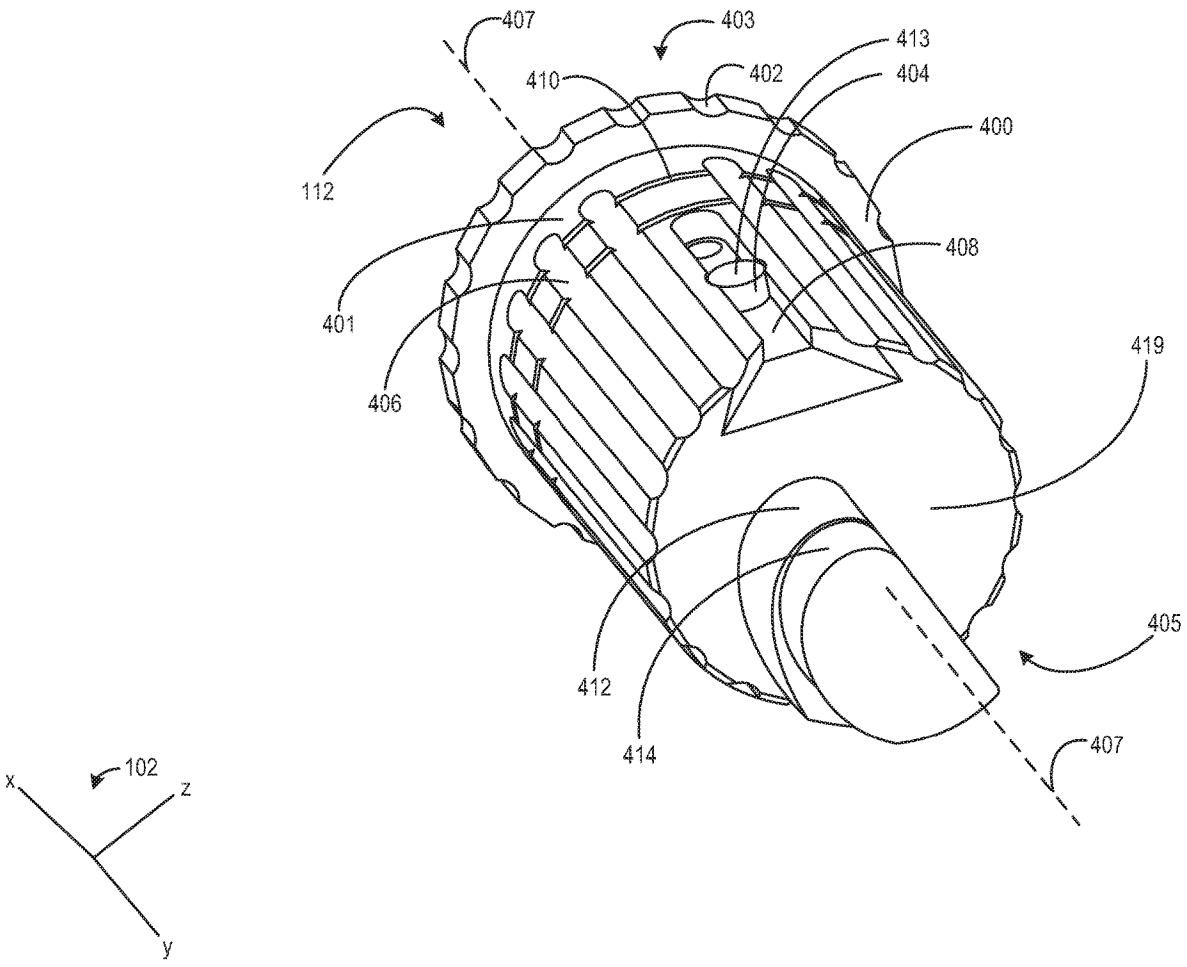
FIG. 4 shows a first perspective view of a cartridge configured to couple with the high-angle sight mount, with a locking pin of the cartridge in a locked position.

FIG. 4 shows a perspective view of the cartridge 112 separated (e.g., decoupled) from the high-angle sight mount (shown by FIGS. 1-3). The cartridge 112 includes a first end 403 and a second end 405. The first end 403 includes an annular extension 400 and the unlock button 202 (shown by FIG. 2), while the second end 405 includes a plurality of cams (e.g., a first cam 412 and a second cam 414) coupled to a cam surface 419 of the cartridge 112. The first cam 412 and the second cam 414 are arranged coaxially relative to each other along a central axis 407 of the cartridge 112. However, while each cam is positioned along the central axis 407, the cams are not centered about the central axis 407. In other words, each cam is intersected by the central axis 407, but a midpoint of each cam is not positioned along the central axis 407, as shown and described in further detail below with reference to FIG. 7. The cartridge 112 is approximately cylindrical in shape, with the central axis 407 extending through a center of the cartridge 112 and parallel to a longest length of the cartridge 112.

The cartridge 112 includes an exterior surface 401, and positioned along the exterior surface 401 is a plurality of channels 406. Each channel extends along the exterior surface 401 in a direction parallel to the central axis 407. In one example, each channel may be configured to reduce a likelihood of debris (e.g., dirt, sand, etc.) from accumulation between the exterior surface 401 of the cartridge 112 and the surfaces of the high-angle sight mount 100 (described above with reference to FIGS. 1-3) when the cartridge 112 is coupled to the high-angle sight mount 100 (e.g., inserted into the cylindrical opening 119). For example, when the cartridge 112 is inserted or removed from the high-angle sight mount 100, debris that would otherwise become lodged between the exterior surface 401 and the cylindrical opening 119 may instead be directed into the channels 406 and subsequently expelled from the channels 406 at the second end 405 of the cartridge 112.

The exterior surface 401 of the cartridge 112 also includes a plurality of circumferential thin grooves 410 positioned around a perimeter of the cartridge 112, with a width of each thin groove 410 in a direction parallel to the central axis 407 being less than a width of each channel 406 in a direction around (e.g., circumferential to) central axis 407. In one example, each thin groove 410 may, in combination with the channels 406, decrease a force of friction between the cartridge 112 and the cylindrical opening 119 when the cartridge 112 is inserted or removed from the high-angle sight mount 100. By reducing the force of friction between the cartridge 112 and the cylindrical opening 119, the cartridge 112 may more easily be inserted or removed from the high-angle sight mount 100. In another example, each thin groove 410 may be positioned along the exterior surface 401 to provide a visual indication of a position of the cartridge 112 when the cartridge 112 is coupled to the high-angle sight mount 100. In other words, one of the first cam 412 or the second cam 414 of the cartridge 112 may be positioned into engagement with the protrusion 127 when the cartridge 112 is inserted into the cylindrical opening 119 of the high-angle sight mount 100 (as described below with reference to FIGS. 10-12), and a position of each thin groove 410 relative to the cylindrical opening 119 may visually indicate to a user which cam (e.g., first cam 412 or second cam 414) is engaged with protrusion 127.

The annular extension 400 positioned at the first end 403 of the cartridge 112 extends outward (e.g., radially away from the central axis 407) from the exterior surface 401. A plurality of notches 402 is positioned along a perimeter of the annular extension 400. Each notch 402 extends in a direction parallel to the central axis 407. The notches 402 may increase a gripping characteristic of the annular extension 400 (e.g., an ability of a user to grip the annular extension 400) in order to increase an ease with which the cartridge 112 may be rotated along its central axis 407. For example, when the cartridge 112 is inserted into the high-angle sight mount 100, a trajectory of a projectile fired from a projectile launcher coupled to the high-angle sight mount 100 may be adjusted by rotation of the cartridge 112 (as described below with reference to FIGS. 10-12). By including the notches 402 along the perimeter of the annular extension 400, a user may more easily rotate the cartridge 112 in order to adjust the trajectory of the projectile. In addition, the notches 402 may provide a surface that a user may identify through touch alone (e.g., without visually identifying the annular extension 400) so that the user may adjust the trajectory while simultaneously sighting a target through the optical dot sight (shown by FIGS. 1-2 and described above).

The exterior surface 401 of the cartridge 112 also includes an indented surface 408 positioned parallel to the central axis 407 and arranged between a pair of the channels 406. Protruding from the indented surface is a first shaft 404, with an end surface 413 of the first shaft 404 configured to be positioned flush with (e.g., not extending above or below relative to) the exterior surface 401 of the cartridge 112 when the first shaft 404 is in a locked position. The first shaft 404 may be urged into the locked position by a biasing member (e.g., a spring) within an interior of the cartridge 112 as shown by FIG. 6 and FIG. 8, and described below. When the first shaft 404 is in the locked position, the cartridge 112 may be locked within the cylindrical opening 119 of the high-angle sight mount 100. Specific details regarding the locking of the cartridge 112 within the cylindrical opening 119 are described below with reference to FIGS. 5-6 and FIGS. 8-9.

FIG. 5 shows the cartridge 112 in a perspective view, with the first shaft 404 positioned into an unlocked position. In one example, the first shaft 404 may be moved into the unlocked position by actuation (e.g., pressing) of the unlock button 202 (shown by FIG. 2) at the first end 403 of the cartridge 112. The first shaft 404 is retracted into an opening 500 (e.g., an aperture) of the cartridge 112, with the opening 500 positioned within the indented surface 408. Actuation of the unlock button 202 to adjust a position of the first shaft 404 is described in further detail below with reference to FIG. 6.

With the first shaft 404 in the unlocked position (e.g., with the end surface 413 of the first shaft 404 positioned flush with the indented surface 408) a guide pin (such as the guide pin 806 shown by FIGS. 8-9 and described below) of the range selector dial 114 may be positioned into face-sharing contact with the indented surface 408 in order to lock the cartridge 112 into the high-angle sight mount 100. Specifically, when the first shaft 404 is retracted into the unlocked position by pressing the unlock button 202, the guide pin of the range selector dial 114 may slide along the indented surface 408 as the cartridge 112 is inserted into the cylindrical opening 119, with the guide pin sliding past the retracted first shaft 404 in a direction from the second end 405 towards the first end 403. The guide pin may then couple (e.g., be positioned in face-sharing contact) with either of a first detent 502 or a second detent 504 positioned within the indented surface 408. The first shaft 404 may then be returned to the locking position by releasing the unlock button 202, thereby preventing the guide pin from sliding out of the indented surface 408. The locking of the cartridge 112 within the high-angle sight mount 100 is described in further detail below with reference to FIG. 6 and FIGS. 8-9.

The cartridge 112 includes a guide slot 506 coupled to the indented surface 408 to increase an ease with which the guide pin may slide into the indented surface 408. For example, an opening of the guide slot (e.g., a portion of the guide slot positioned nearest to the second end 405) has a first length 508 positioned along the cam surface 419, and the opening tapers to couple to the indented surface 408 with a second length 510. The first length 508 is greater (e.g., an increased amount of length) than the second length 510 in order to increase an ability of a user to position the guide pin within the guide slot 506 and slide the guide pin toward the indented surface 408 without visual confirmation of the position of the guide pin relative to the indented surface 408. In other words, the guide pin may be more easily located and positioned within the guide slot 506 due to the increased first length 508 of the opening of the guide slot 506 relative to the second length 510 at the indented surface 408. Other aspects of the cartridge 112 related to insertion and removal of the cartridge from the high-angle sight mount is described below with reference to FIG. 6.

FIG. 6 shows a cross-sectional view of the cartridge 112 including a quick-release element 650 comprising the unlock button 202 and the first shaft 404. The cartridge 112 is shown with the unlock button 202 in a position between fully pressed and fully released, and with the first shaft 404 accordingly in a position between fully retracted (as shown by FIG. 5) and fully extended (as shown by FIG. 4).

The unlock button 202 is positioned along the central axis 407 at the first end 403 of the cartridge 112. The annular extension 400 of the cartridge 112 extends in a direction around the central axis 407 (e.g., circumferential to the central axis 407), and an outer annular surface 615 of the annular extension 400 is positioned parallel to the unlock button 202 and around an outer surface 610 (e.g., around, relative to the central axis 407) of the unlock button 202.

The annular extension 400 and unlock button 202 are each centered on the central axis 407. In other words, the central axis 407 intersects a midpoint 612 of the annular extension 400, as well as a midpoint 617 of the outer surface 610 of the unlock button 202, as is also shown by FIG. 9. The midpoint 617 of the outer surface 610 of the unlock button 202 is shown positioned a distance 613 from the midpoint 612 of the annular extension 400. Depending on the position of the unlock button 202 (e.g., fully pressed, fully released, or positioned in a plurality of positions between fully pressed and fully released), the distance 613 may increase or decrease. By centering the annular extension 400 and the unlock button 202 along the central axis 407, a user may more easily locate the unlock button 202 without visually identifying the unlock button 202. For example, as a user sights a target through an optical dot sight (e.g., the optical dot sight 140 shown by FIGS. 1-2) coupled to the high-angle sight mount 100 (shown by FIGS. 1-3), the user may identify the location of the unlock button 202 of the cartridge 112 by touch due to the positioning of the annular extension 400 relative to the unlock button 202. Therefore, the user may actuate (e.g., press) the unlock button 202 in order to install or remove the cartridge 112 from the high-angle sight mount 100 without diverting the user's attention from the optical dot sight.

The unlock button 202 is coupled to a second shaft 606, with the second shaft 606 positioned within a chamber 619 of the cartridge 112. The second shaft 606 extends away from the unlock button 202 and towards the second end 405 in a direction parallel to the central axis 407. The unlock button 202 is biased (e.g., urged) in a direction away from the second end 405 by a first biasing member 604 (herein referred to as a first spring 604) coupled between the second shaft 606 and an interior surface 616 of the cartridge 112. A first gasket 600 is positioned between a flat end 602 of the second shaft 606 and the unlock button 202. In one example, the first gasket 600 may be made of a flexible and impermeable (e.g., impermeable to water, etc.) material such as rubber. The first gasket 600 may reduce a likelihood of contamination of the chamber 619 of the cartridge 112 by debris or corrosion (e.g., due to water, dirt, etc.).

The first shaft 404 is shown positioned perpendicular to the central axis 407 and extending into the chamber 619 of the cartridge 112. The first shaft 404 is biased (e.g., urged) away from the chamber 619 and through the opening 500 of the cartridge 112 by a second biasing member 618 (herein referred to as a second spring 618). An amount of compression of the second spring 618 determines a position of the end surface 413 of the first shaft 404, with the amount of compression resulting from an actuation of the unlock button 202. For example, the first shaft 404 includes a first pair of extensions 631 formed by an outer surface of the first shaft 404, and each extension of the first pair of extensions 631 includes a first curved surface 620. The second shaft 606 includes a central slot (not shown) shaped to receive the first shaft 404. In other words, the central slot of the second shaft 606 extends along a length of the second shaft 606 in a direction parallel to the y-axis shown by reference axes 102 such that an end 630 of the second shaft 606 opposite to the unlock button 202 (relative to the central axis 407) is split into a second pair of extensions 632. The first shaft 404 is positioned between the second pair of extensions 632 such each extension of the first pair of extensions 631 of the first shaft 404 is in face-sharing contact with a corresponding extension of the second pair of extensions 632 of the second shaft 606. In other words, the first curved surface 620 of each extension of the first pair of extensions 631 is direct contact with the corresponding second curved surface 622 of the corresponding extension of the second pair of extensions 632. The first shaft 404 may include a hollow region 626 positioned within an interior of the first shaft 404 and between each of the first pair of extensions 631. The first shaft 404 and second shaft 606 may be shaped such that the first shaft 404 and second shaft 606 are slideable relative to each other, but the first shaft 404 and second shaft 606 may not rotate relative to each other.

The second curved surface 622 is configured such that a change in position of the second shaft 606 along the central axis 407 of the cartridge 112 (e.g., in a direction parallel to the y-axis shown by reference axes 102) results in a change in position of the first shaft 404 in a direction perpendicular to the central axis 407 (e.g., in a direction parallel to the z-axis shown by reference axes 102). In other words, pressing or releasing the unlock button 202 moves the second shaft 606 along the central axis 407, and the movement of the second shaft 606 adjusts a position of the first shaft 404 due to the direct contact between the first curved surface 620 and the second curved surface 622. The movement of the first shaft 404 in response to the movement of the second shaft 606 as described above adjusts an amount of compression of the second spring 618 coupled to the first shaft 404, thereby adjusting a position of the end surface 413 of the first shaft 404. In this way, the end surface 413 may be moved from a first position, wherein the end surface 413 is flush with (e.g., not extending above or below, relative to the z-axis) the exterior surface 401 of the cartridge 112 while the unlock button 202 is in a fully released position, to a second position, wherein the end surface 413 is flush with the indented surface 408 while the unlock button 202 is in a fully pressed position. In some examples, the second position may be located below the indented surface 408 (e.g., further retracted, relative to the z-axis). The first shaft 404 includes a second gasket 608 surrounding a portion of the first shaft 404 within the opening 500. Similar to the first gasket 600, the second gasket may reduce a likelihood of debris (e.g., dirt, water, etc.) from entering the cartridge 112. The cams of the cartridge 112 (e.g., first cam 412 and second cam 414) are described below with reference to FIG. 7.

FIG. 7 shows a view of the second end 405 of the cartridge 112, including the first cam 412 and the second cam 414. The first cam 412 and the second cam 414 are each formed by a plurality of surfaces, including a first flat surface 700 of the first cam 412 and a second flat surface 701 of the second cam 414. For example, the first cam 412 is formed as an extension of a portion of the cam surface 419 in a direction parallel to the central axis, and away from the first end 403 (shown by FIGS. 4-6) and the second end 405. The first cam 412 includes a first continuously curved surface 704 curving around the central axis, and a first joining surface 716 coupled to the first continuously curved surface 704. The first continuously curved surface 704 and the first joining surface 716 are each coupled to the first flat surface 700. The first cam 412 also includes a first cam surface 705, with the first cam surface 705 positioned parallel to the cam surface 419 of the cartridge 112, and with a perimeter of the first cam surface 705 defined by the surfaces described above (e.g., the first continuously curved surface 704, the first flat surface 700, and the first joining surface 716). The first cam surface 705 has a surface area less than half of a surface area of the cam surface 419. In other words, a surface area of the first cam 412 in a cross-sectional plane parallel to the cam surface 419 is less than half of a surface area of the cartridge 112, taken at the second end 405 of the cartridge 112, along a cross-sectional plane parallel to the cam surface 419.

The second cam 414 is formed as an extension of a portion of the first cam 412 in a direction parallel to the central axis, and away from the cam surface 419 and the first cam surface 705. The second cam 414 includes a second continuously curved surface 702 curving around the central axis, and a second joining surface 714 coupled to the second continuously curved surface 702. The second continuously curved surface 702 and the second joining surface 714 are each coupled to the second flat surface 701. The second cam 414 includes a second cam surface 703, with the second cam surface 703 positioned parallel with the cam surface 419 and first cam surface 705. A perimeter of the second cam surface 703 is defined by the second continuously curved surface 702, the second joining surface 714 coupled to the second continuously curved surface 702, and the second flat surface 701 coupled to both of the second joining surface 714 and the second continuously curved surface 702. A surface area of the second cam surface 703 is less than half of the surface area of the cam surface 419. In other words, a surface area of the second cam 414 in a cross-sectional plane parallel to the cam surface 419 is less than half of the surface area of the cartridge 112, taken at the second end 405 of the cartridge 112, along the cross-sectional plane parallel to the cam surface 419.

As described above, the first cam 412 includes the first flat surface 700, and the second cam 414 includes the second flat surface 701 (which may herein be referred to as first reference surface 700 and second reference surface 701, respectively). The first reference surface 700 and second reference surface 701 are each flat (e.g., without curvature) relative to both of the first continuously curved surface 704 and the second continuously curved surface 702. When either the first cam 412 or the second cam 414 are engaged with (e.g., in face-sharing contact with) the protrusion 127 of the platform 101 (shown by FIG. 1 and FIGS. 10-12) as described below with reference to FIGS. 10-12, the corresponding reference surface (e.g., first reference surface 700 corresponding to the first cam 412, or second reference surface 701 corresponding to the second cam 414) defines an initial position of the platform 101. When the cartridge 112 is rotated around its central axis, each of the first cam 412 and the second cam 414 also rotate around the central axis. When the first cam 412 is engaged with the protrusion 127, a rotation of the cartridge 112 may move the protrusion 127 from engagement with the first reference surface 700 to engagement with the first continuously curved surface 704. Similarly, when the second cam 414 is engaged with the protrusion 127, a rotation of the cartridge 112 may move the protrusion 127 from engagement with the second reference surface 701 to engagement with the second continuously curved surface 702. Whether the first cam 412 or the second cam 414 is engaged with the protrusion 127 depends on which cam is selected by the user (as described below with reference to FIG. 10). For example, if the first continuously curved surface 704 is engaged with the protrusion 127, the protrusion 127 is forcibly moved from the initial position (e.g., a position corresponding to engagement with the first reference surface 700) to a plurality of positions defined by the curvature of the first continuously curved surface 704 as the cartridge 112 is rotated. An example of rotation of the cartridge is described below with reference to FIG. 10.

Because the curvature of the first continuously curved surface 704 of the first cam 412 and the curvature of the second continuously curved surface 702 of the second cam 414 each define a position of the protrusion 127 (and therefore, the platform 101) when the corresponding surface is in engagement with the protrusion 127, the first continuously curved surface 704 and the second continuously curved surface 702 have a different amount of curvature relative to each other. In this way, each cam may adjust a position of the protrusion 127 and platform 101 by a different amount (depending on which cam is in engagement with the protrusion 127) for a same amount of rotation of the cartridge 112. In other words, if the protrusion 127 is initially engaged with the first reference surface 700 and the cartridge 112 is rotated by an amount while the first cam 412 is selected, the first continuously curved surface 704 presses against the protrusion 127 and moves the protrusion 127 and platform 101 together by a first amount of distance. If the protrusion 127 is instead initially engaged with the second reference surface 701 and the cartridge 112 is rotated by a same amount (e.g., a same amount of rotation as above) while the second cam 414 is selected, the second continuously curved surface 702 presses against the protrusion 127 and moves the protrusion 127 and platform 101 together by a second amount of distance, with the second amount being different than the first amount.

The curvature of the first continuously curved surface 704 and the second continuously curved surface 702 may not be uniform (e.g., may not be a same amount of distance from an intersection 706 of the central axis with each cam). For example, a first distance 707 from the intersection 706 to the second reference surface 701 along the second cam surface 703 is less than a second distance 708 from the intersection 706 to a first location 717 along the second continuously curved surface 702. The second distance 708 is less than a third distance 710 from the intersection 706 to a second location 719 along the second continuously curved surface 702, and the third distance 710 is less than a fourth distance 712 from the intersection 706 to a third location 721 along the second joining surface 714. In other words, the second cam 414 (for example) is configured such that when the second cam 414 is in engagement with the protrusion 127, the second reference surface 701 defines a lowest position of the protrusion 127 (e.g., a least amount of movement of the protrusion 127 due to the second cam 414 pressing against the protrusion 127), the second joining surface 714 defines a highest position of the protrusion 127 (e.g., a greatest amount of movement of the protrusion 127), and the second continuously curved surface 702 defines a plurality of positions between the lowest position and the highest position. While the second cam 414 has been described as an example, the first cam 412 is similarly structured, with the exception that a lowest position of the protrusion 127 due to engagement with the first cam 412 is defined by the first reference surface 700, a highest position of the protrusion 127 defined by the first joining surface 716 is a different highest position than the highest position defined by the second joining surface 714, and that a plurality of positions of the protrusion 127 defined by the first continuously curved surface 704 differs from the plurality of positions defined by the second continuously curved surface 702, since the curvature of the first continuously curved surface 704 is different than the curvature of the second continuously curved surface 702.

In the embodiment shown by FIGS. 2-12, the first reference surface 700 and second reference surface 701 are slightly offset from each other (e.g., spaced apart by a relatively small distance compared to a length of each reference surface). In one example, first reference surface 700 may be positioned slightly closer to intersection 706 than second reference surface 701. By offsetting the reference surfaces from each other, a position of the protrusion 127 when the first reference surface 700 is in engagement with the protrusion 127 may be different than a position of the protrusion 127 when the second reference surface 701 is in engagement with the protrusion 127. In this way, a trajectory of a projectile fired from the projectile launcher may be adjusted differently depending on which of the first reference surface 700 or second reference surface 701 is in engagement with the protrusion 127 (e.g., depending on which of the first cam 412 or second cam 414 is selected). In an alternate embodiment, the first reference surface 700 and second reference surface 701 may be included together as a single reference surface that is shared by both of the first cam 412 and the second cam 414. The single reference surface may be substantially flat such that in one example, a difference between a distance of the first reference surface 700 from the central axis of the cartridge 112 in a first direction perpendicular to the central axis, and a distance of the second reference surface 701 from the central axis along a second direction parallel to the first direction, is less than 1 micrometer. By configuring the single reference surface in this way, a resistance to a sliding movement of the cartridge 112 (as described below with reference to FIG. 10) may be reduced. Engagement of the cams with the protrusion 127 to adjust a position of the platform 101 is further described below with reference to FIGS. 10-12.

FIG. 8 shows a cross-sectional view of the cartridge 112 positioned along the central axis 105 of a chamber 821 formed by the annular portion 122 and the range selector dial 114 of the high-angle sight mount 100. The central axis 105 intersects a midpoint 811 of the cylindrical opening 119. In order to insert the cartridge 112 into the chamber 821, the central axis 407 of the cartridge 112 is aligned coaxially with (e.g., parallel to, and in a same position as) the central axis 105 of the chamber 821. A cartridge diameter 800 is configured to be slightly less than a chamber diameter 802 so that the cartridge 112 may fit within (e.g., slide into) the chamber 821 and cylindrical opening 119.

An interior surface 804 of the annular portion 122 is adapted to couple with the exterior surface 401 of the cartridge 112. Included within the interior surface 804 is an opening 815 (e.g., an aperture) configured to receive a third shaft 806 (which may also be referred to herein as a guide pin). The third shaft 806 includes a base end 825 and a rounded end 823, with the base end 825 and the rounded end 823 formed together as one piece. The third shaft 806 is positioned perpendicular to the central axis 105 of the chamber 821 and is urged into the opening 815 by a third biasing member 814 (herein referred to as a third spring 814). The base end 825 and third spring 814 are positioned within a hollow fastener 812 (e.g., a threaded fastener with an interior chamber), and the hollow fastener 812 is fastened into the range selector dial 114. In other words, the third spring 814 and base end 825 fit into a cavity formed within an interior of the hollow fastener 812, with the hollow fastener 812 fastened to the range selector dial 114 in such a way that the third spring 814 applies a force to the third shaft 806 to push the rounded end 823 of the third shaft 806 through the opening 815 and into a chamber 821 formed by the interior surface 804 of the chamber 821. In this configuration, the rounded end 823 extends into the chamber 821 and may be partially retracted into the opening 815 by applying a force (e.g., pressing) against the rounded end 823 in a direction towards the opening 815. A length 816 of the base end 825 is less than a length 818 of the interior of the hollow fastener 812 such that when the rounded end 823 is pressed in a direction toward the opening 815, the base end 825 can move within the interior of the hollow fastener 812, and the rounded end 823 is retracted into the opening 815.

In order to insert the cartridge 112 into the cylindrical opening 119, the unlock button 202 is pressed (as described above with reference to FIG. 6) to retract the first shaft 404 into the cartridge 112 (e.g., to move the end surface 413 of the first shaft 404 into a position flush with the indented surface 408). The central axis 407 of the cartridge 112 is then positioned coaxially relative to the central axis 105 of the cylindrical opening 119, and the cartridge 112 is inserted into the cylindrical opening 119. The guide slot 506 guides the indented surface 408 of the cartridge 112 to couple with the rounded end 823 of the third shaft 806, compressing the third spring 814 and partially retracting the rounded end 823 into the opening 815. The rounded end 823 slides along the indented surface 408 as the cartridge 112 slides through the chamber 821. Once the rounded end 823 slides past the end surface 413 of the first shaft 404, the unlock button 202 may be released in order to extend the first shaft 404 to its unlocked position (as described above with reference to FIG. 4). The rounded end 823 is then pressed into either the first detent 502 or the second detent 504 (as described below with reference to FIG. 10), with the rounded end 823 coupling to the first detent 502 when the user selects engagement of the second cam 414 with the protrusion 127, and the rounded end 823 instead coupling with the second detent 504 when the user selects engagement of the first cam 412 with the protrusion 127. The rounded end 823 extends into the chamber 821 in a position between a first length 808 and a second length 810 of the interior surface 804, with the first length 808 and second length 810 configured such that the first cam 412 couples with the protrusion 127 when the rounded end 823 couples with the second detent 504, and the second cam 414 couples with the protrusion 127 when the rounded end 823 couples with the first detent 502. The first length 808 and second length 810 are also configured (e.g., a position of the rounded end 823 is configured) such that a stopping surface 827 coupled to the indented surface 408 does not allow the rounded end 823 to slide beyond the second detent 504 in a direction toward the first end 403 of the cartridge 112. In this way, the cartridge 112 may be locked into the chamber 821 until the user presses the unlock button 202 to retract the first shaft 404 and release the cartridge 112. In order to illustrate the insertion of the cartridge 112 into the high-angle sight mount 100, aspects related to the unlock button 202 and direction of insertion are described below with reference to FIG. 9.

FIG. 9 shows a perspective view of the cartridge 112 being inserted into the high-angle sight mount 100, as described above with reference to FIG. 8. The cartridge 112 is inserted along the central axis 105 as described above, with the central axis 105 positioned perpendicular to the mounting axis 110 so that the cartridge 112 is inserted into only one end (e.g., first end 316) of the high-angle sight mount 100.

The unlock button 202 has a first diameter 902, while the annular extension 400 has an inner diameter 900 and an outer diameter 908. As described above with reference to FIG. 6, the midpoint 617 of the outer surface 610 of the unlock button 202 and the midpoint of the annular extension 400 are both located along the central axis 407 of the cartridge 112. The first diameter 902 of the unlock button 202 is smaller (e.g., a less amount of length) than the inner diameter 900 of the annular extension 400. In one example, the first diameter 902 may be approximately a same amount of length as an average diameter of a thumb (e.g., a thumb of a user). By configuring the diameters described above in this way, an ease with which a user may press or release the unlock button 202 to decouple the cartridge 112 from the high-angle sight mount 100 may be increased.

The range selector dial 114 of the high-angle sight mount 100 also includes a plurality of semi-circular grooves 906 positioned along a perimeter of the cylindrical opening 119. Each semi-circular groove 906 curves in a direction from the cylindrical opening 119 to an exterior surface 905 of the range selector dial 114. In one example, the semi-circular grooves 906 may increase an ability of a user to grip or steady the range selector dial 114 during insertion or removal of the cartridge 112, and may also provide an alternate surface for the user to grip in order to rotate the range selector dial 114 relative to the annular portion 122 (shown by FIGS. 1-2 and FIG. 8).

FIG. 10 shows a perspective view of the cartridge 112 installed into the high-angle sight mount 100 (e.g., inserted into the locked position as described above) and illustrates a method of selecting which cam (e.g., the first cam 412, or the second cam 414) of the cartridge is in engagement with the protrusion 127.

As an example, the second reference surface 701 is shown engaged with the protrusion 127. As a result, the platform 101 is in a second reference position. The second reference position is a position corresponding to a lowest vertical position of the platform 101 relative to the base 118 when the second cam 414 is engaged with the protrusion 127, in contrast to a different, first reference position corresponding to a lowest vertical position of the platform 101 relative to the base 118 when the first cam 412 is engaged with the protrusion 127. The second cam 414 has been selected by the user so that when the cartridge 112 is rotated in a first direction 1006 within the chamber 821 of the high-angle sight mount 100, the protrusion 127 will disengage the second reference surface 701 and instead engage the second continuously curved surface 702 of the second cam 414. The engagement of the second continuously curved surface 702 with the protrusion 127 will gradually rotate the platform 101 coupled to the protrusion 127 as the cartridge 112 is rotated.

In order to instead select the first cam 412 for engagement with the protrusion 127 (e.g., in order to switch selection from the second cam 414 to the first cam 412), the user returns the second reference surface 701 into engagement with the protrusion 127 by rotating the cartridge 112 in a direction opposite to the first direction 1006. The cartridge 112 may then slide along the central axis 105 of the chamber 821 for a first length 1000 in a direction toward the high-angle sight mount 100. By sliding the cartridge 112 toward the high-angle sight mount, the rounded end 823 of the third shaft 806 (shown by FIG. 8) disengages the first detent 502 of the indented surface 408 and instead engages the second detent 504 (also shown by FIG. 8). Similarly, the second cam 414 disengages the protrusion 127 and the first cam 412 slides into engagement with the protrusion 127. Specifically, the first reference surface 700 slides into engagement with the protrusion 127, with the first cam 412 moving a second length 1002 (with the second length 1002 being a same amount of length as the first length 1000 in a direction toward the protrusion 127 and along the central axis 105) so that when the cartridge 112 is rotated in the first direction 1006, the protrusion 127 instead disengages the first reference surface 700 and engages the first continuously curved surface 704. In this way, the engagement of the first continuously curved surface 704 with the protrusion 127 will gradually rotate the platform 101 coupled to the protrusion 127 as the cartridge 112 is rotated.

In order to switch from the first cam 412 to the second cam 414, the process described above is repeated, but the cartridge 112 instead slides away from the high-angle sight mount 100. In other words, the user engages the first reference surface 700 with the protrusion 127 and slides the cartridge 112 away from the high-angle sight mount 100 along the central axis 105 until the rounded end 823 of the third shaft 806 disengages the second detent 504 and engages the first detent 502. An example operation of the cartridge 112 within the high-angle sight mount 100 is described below with reference to FIG. 11.

FIG. 11 shows an example of rotation of the cartridge 112 from the second reference position (described above). The cartridge 112 rotates within the chamber 821 (shown by FIGS. 9-10) along the central axis 407 of the cartridge 112 (also shown by FIGS. 9-10). As the cartridge 112 rotates, the first cam 412 and the second cam 414 coupled to the cartridge 112 also rotate.

View 1100 shows the protrusion 127 engaged with the second reference surface 701 of the second cam 414. In the example shown by views 1100, 1102, and 1104, the second cam 414 has been selected (e.g., moved into a position for engagement with the protrusion as shown by FIG. 10). View 1100 shows the cartridge 112 in the second reference position (e.g., not rotated relative to a position in which the second reference surface 701 engages the protrusion 127), while view 1102 shows the cartridge 112 rotated by an amount in a direction 1110, and view 1104 shows the cartridge additionally rotated by the same amount (e.g., rotated again by a same amount relative to the rotation of the cartridge 112 in view 1104) in the same direction 1110. In other words, the cartridge 112 shown by view 1100 is not rotated, while in view 1102 the cartridge 112 has been rotated once relative to view 1100, and in view 1104 the cartridge 112 has been rotated twice relative to view 1100.

View 1100 shows the platform 101 positioned a first distance 1114 in a direction parallel to the z-axis (shown by reference axes 102) from an initial position of the second reference surface 701 corresponding with the second reference position (and indicated by axis 1106). Axis 1106 indicates an initial position of the second reference surface 701 across each of the three views (e.g., views 1100, 1102, and 1104). When the cartridge 112 is rotated a first time (e.g., as shown in view 1102), the platform 101 is positioned a second distance 1116 from the initial position (e.g., a second distance 1116 from the axis 1106), with the second distance 1116 being greater than the first distance 1114. In other words, as the cartridge 112 rotates, the second cam 414 rotates along with it by a same amount around the central axis of the cartridge 112. The rotation of the second cam 414 results in disengagement of the protrusion 127 with the second reference surface 701. The protrusion 127 instead engages with the second continuously curved surface 702 of the second cam 414. Because the location of contact between the protrusion 127 and the second continuously curved surface 702 is vertically above an initial position of the protrusion 127 corresponding to the second reference position (e.g., vertically above the axis 1106 in a direction parallel to the z-axis), the distance of the platform 101 from the axis 1106 has increased. Additionally, due to the location of contact between the protrusion 127 and the second continuously curved surface 702, the protrusion 127 and platform 101 are angled by first angle 1120 relative to their initial position. In other words, the engagement of the second continuously curved surface 702 with the protrusion 127 causes the platform 101 and the protrusion 127 to pivot together around the pivot axis 104 (shown by FIGS. 1-3 and FIG. 12).

View 1104 shows the cartridge 112 additionally rotated by a same amount relative to the position of the cartridge 112 shown by view 1102. The platform 101 is shown a third distance 1118 from the axis 1106, with the third distance 1118 greater than both of the first distance 1114 and the second distance 1116. Additionally, the protrusion 127 and platform 101 are angled by a second angle 1122 relative to their initial position, with the second angle 1122 greater than the first angle 1120. In this way, as the cartridge 112 is rotated in the direction 1110, the protrusion 127 and platform 101 are gradually distanced and gradually angled relative to their initial position until reaching a maximum distance and a maximum angle corresponding to engagement of the second joining surface 714 with the protrusion 127. The second joining surface 714 is configured such that when the protrusion 127 engages the second joining surface 714, further rotation of the cartridge 112 does not increase an amount of distance or angle of the platform 101 and protrusion 127 relative to their position when the protrusion 127 first engages the second joining surface 714. In other words, each location along the second joining surface 714 may be a same amount of distance (e.g., same relative to other locations along the second joining surface 714) from the intersection 706 of the central axis 407 (shown by FIG. 7) of the cartridge 112 with the cams.

While the second cam 414 is shown selected for engagement with the protrusion 127 by FIG. 11, the first cam 412 functions in a similar way but adjusts the position and angle of the protrusion 127 and platform 101 by a different amount than the second cam 414. For example, if the first cam 412 is selected and in engagement with the protrusion 127, rotation of the cartridge 112 in the direction 1110 will result in an increased distance and angle of the protrusion 127 and platform 101 relative to their initial position (e.g., the first reference position described above, due to the first reference surface 700 in engagement with the first cam 412). However, the amount of change of the distance and angle of the protrusion 127 and platform 101 from the first reference position resulting from rotation of the first cam 412 (and therefore, engagement of the protrusion 127 with the first continuously curved surface 704) is different than the distances and angles shown by FIG. 11 and described above (e.g., with respect to rotation of the second cam 414 from the second reference position) since the curvature of the first continuously curved surface 704 differs from the curvature of the second continuously curved surface 702. Additionally, locations along the first joining surface 716 may each be positioned a same distance away from the intersection 706, but that distance may be different than the distance of the locations along the second joining surface 714 from the intersection 706 (as described above). In other words, when the cartridge 112 has rotated to an amount at which the protrusion 127 engages the first joining surface 716, the distance and angle of the protrusion 127 and platform 101 from the first reference position may no longer increase with further rotation. However, that distance and angle may be different than the distance and angle resulting from engagement of the protrusion 127 with the second joining surface 714 relative to the second reference position.

FIG. 12 shows a perspective view of the cartridge 112 coupled to the high-angle sight mount 100 similar to the arrangement shown by FIG. 10. However, in the view shown by FIG. 12, the cartridge 112 has been rotated within the chamber 821 (shown by FIGS. 8-9) according to the description of FIG. 11 above. In other words, FIG. 12 shows the cartridge 112 rotated according to the view 1104 shown by FIG. 11.

By rotating the cartridge 112 within the chamber 821, the platform 101 is pivoted along the pivot axis 104. When a sight (such as the optical dot sight 140 shown by FIGS. 1-2) is coupled to the platform 101, the pivoting of the platform 101 relative to the base 118 due to the engagement of one of the cams (in the example of FIGS. 10-12, the second cam 414) with the protrusion 127 also results in a pivoting of the optical dot sight. In other words, because the optical dot sight couples to the platform 101, when the platform 101 is pivoted by the rotation of the cartridge 112, the optical dot sight is pivoted by a same amount.

Configuring the high-angle sight mount 100 in this way increases an ease with which a user can hit a target sighted through the sight with a projectile fired from the projectile launcher. For example, the curvature of the continuously curved surfaces of each cam (e.g., the first continuously curved surface 704 of the first cam 412, and the second continuously curved surface 702 of the second cam 414) may be configured to pivot the sight (as described above) by a certain amount according to an amount of rotation of the cartridge 112 within the chamber 821. The user may rotate the cartridge 112 according to an estimated, sighted, or calculated distance to the target so that the range indicator 116 indicates the desired target distance on the range selector dial 114. The sight is then pivoted by an amount according to the selected range in order to adjust the firing direction of the projectile launcher to more accurately hit the target with a projectile.

In an example operation of the high-angle sight mount according to the description above, the high-angle sight mount is mounted to a projectile launcher, such as a grenade launcher. The user may carry a plurality of different cartridges (according to the cartridge description above), with each cartridge including cams configured with different amounts of curvature of their continuously curved surface. For example, a first cartridge may include a cam configured to adjust a trajectory of a projectile with a first mass, as well as a cam configured to adjust a trajectory of a projectile with a second mass different from the first mass. A second cartridge may include cams that are both configured to adjust a trajectory of a projectile with the first mass, but a first cam may be configured to adjust the trajectory at low elevations where environmental air density is greater (e.g., sea level), and a second cam may be configured to adjust the trajectory at high elevations where air density is reduced. In this example, the user is firing a projectile with the first mass at a target at approximately sea level, and so the user aligns the second cartridge with the chamber of the high-angle sight mount. The user presses the unlock button of the cartridge in order to retract the first shaft of the cartridge, and guides the guide pin of the range selector dial 114 into the guide slot of the cartridge. The user slides the cartridge in the direction of the high-angle sight mount until the guide pin engages the first detent within the indented surface of the cartridge, and the user then releases the unlock button to lock the cartridge into the chamber. With the cartridge locked into the chamber, the protrusion of the platform is engaged with the first reference surface of the first cam, and the cartridge is rotated to simultaneously rotate the range selector dial so that a desired range (e.g., a distance from the user to the target) is indicated by the range indicator. As the cartridge is rotated, the continuously curved surface of the first cam pivots the protrusion and platform by an amount according to the desired range. The user then aligns the aiming dot of the sight with the target and fires the projectile launcher. By pivoting the platform (and the sight) as described above, the firing direction of the projectile is adjusted to arc the projectile toward the target.

FIGS. 1-12 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In one embodiment, an article of manufacture includes: a base having a cylindrical opening; a cartridge rotatably mounted in the cylindrical opening and having a quick-release element and a cam surface; and a pivoting sight mount surface engaging the cam surface. In a first example of the article of manufacture, the quick-release element is positioned at an opposite end of the cartridge from the cam surface, the cartridge comprising a plurality of cam surfaces axially offset and adjacent one another, the cylindrical opening formed by a chamber in the base that is open at both ends, the article further comprising a biasing member urging the pivoting sight directly against one of the cam surfaces. A second example of the article of manufacture optionally includes the first example, and further includes wherein the cam surface includes a first flat surface and a second flat surface, with the first flat surface forming a first end of a first cam and the second flat surface forming a first end of a second cam, wherein a first continuous curved surface forms a second end of the first cam and a second continuous curved surface forms a second end of the second cam, wherein the first continuous curved surface and second continuous curved surface each curve with a different curvature around a central axis of the cartridge, wherein a third surface of the first cam and a fourth surface of the second cam are each perpendicular to the cam surface, with the third surface of the first cam bounded by the first continuous curved surface and the fourth surface of the second cam bounded by the second continuous curved surface, wherein a surface area of the third surface and a surface area of the fourth surface are each less than half of a surface area of the cam surface, and wherein the first continuous curved surface defines a gradual rotation of the sight mount surface by a first amount and the second continuous curved surface defines a gradual rotation of the sight mount surface by a second amount. A third example of the article of manufacture optionally includes one or both of the first and second examples, and further includes wherein the quick-release element is adapted to decouple the cartridge from the cylindrical opening, wherein the cartridge is slideable along a central axis of the cylindrical opening from a first position to a second position, with a first surface of the plurality of cam surfaces aligned with the sight mount surface in the first position and a second surface of the plurality of cam surfaces aligned with the sight mount surface in the second position. A fourth example of the article of manufacture optionally includes one or more or each of the first through third examples, and further includes wherein a pivot in the base about which the sight mount pivots is positioned opposite from the cartridge on a downstream side along a projectile trajectory of a projectile sighted by a sight mounted to the sight mount surface. A fifth example of the article of manufacture optionally includes one or more or each of the first through fourth examples, and further includes wherein the quick-release element includes: an unlock button coupled to a first end of the cartridge; an indented surface positioned along an outer surface of the cartridge, between the first end and a second end opposite the first end; a first biasing member coupled to a first shaft, the first shaft positioned within an interior of the cartridge and perpendicular to a cartridge central axis, with the first shaft urged into an opening of the indented surface by the first biasing member; and a second biasing member coupled to a second shaft, with the second shaft positioned parallel to the cartridge central axis within the interior of the cartridge and urged directly against the unlock button by the second biasing member; and wherein a first surface of the first shaft is in direct contact with a second surface of the second shaft. A sixth example of the article of manufacture optionally includes one or more or each of the first through fifth examples, and further includes a first detent and a second detent positioned within the indented surface, and a protrusion extending from an interior surface of the cylindrical opening and urged into the cylindrical opening by a third biasing member, with the protrusion adapted to couple with either of the first detent or the second detent. A seventh example of the article of manufacture optionally includes one or more or each of the first through sixth examples, and further includes: a plurality of elongate channels positioned along an outer surface of the cartridge and extending in a direction parallel to a cartridge central axis, wherein each elongate channel of the plurality of elongate channels has a first width in a direction around the outer surface and the cartridge central axis; and a plurality of thin grooves within the outer surface extending around the cartridge central axis, wherein each thin groove of the plurality of thin grooves has a second width in a direction parallel to the cartridge central axis, and wherein the second width is less than the first width. An eighth example of the article of manufacture optionally includes one or more or each of the first through seventh examples, and further includes: an annular extension coupled to an outer surface of the cartridge at a first end adjacent the quick release element, the annular extension including a plurality of notches extending in a direction parallel to a cartridge central axis and positioned along an outer surface of the annular extension, and wherein a first midpoint of the annular extension and a second midpoint of an unlock button of the quick release element are each positioned along the cartridge central axis, and wherein the second midpoint is positioned between the first midpoint and a second end opposite the first end; and a guide slot formed by the outer surface, the guide slot including a first opening with a first length positioned at the second end and a second opening with a second length coupled to an indentation of the outer surface, with the first length being greater than the second length.

In one embodiment, a system includes: a base including a first end and a second end; a platform rotatably coupled to the base by a shaft and a spring and adapted to pivot relative to the base along a central axis of the shaft, the shaft positioned closer to the second base end than the first base end, with the platform including: a first surface adapted to couple to a sight; a second surface positioned opposite to the first surface in a direction toward the base; and a protrusion coupled to the second surface and extending away from the first surface, with the protrusion positioned closer to the first base end than the second base end; a cartridge removably coupled to a range selector, the cartridge including: an unlock button coupled to a first end surface; and a plurality of cams coupled to a second end surface, the second end surface positioned parallel and opposite to the first end surface along a cartridge central axis, and a midpoint of the plurality of cams is positioned away from the cartridge central axis in a direction perpendicular to the cartridge central axis; and an open space formed between the second surface and the base, adapted to receive the plurality of cams, with each cam of the plurality of cams adapted to be in face-sharing contact with the protrusion depending on an axial position of the cartridge. In a first example of the system, each cam includes a first cam surface arranged parallel to the second end surface and positioned away from the second end surface along the cartridge central axis, a second cam surface arranged perpendicular to the second end surface and extending between the second end surface and the first cam surface, and wherein the first cam surface is not in contact with any surface of the base or platform. A second example of the system optionally includes the first example, and further includes wherein the second cam surface of each cam extends into the open space and curves continuously in a direction away from the cartridge central axis and around the cartridge central axis. A third example of the system optionally includes one or both of the first and second examples, and further includes wherein the second cam surface of the first cam is positioned closer to the second end surface than the second cam surface of the second cam, and wherein a curvature of the second cam surface of the first cam is greater than a curvature of the second cam surface of the second cam.

In one embodiment, a system for a sight mount includes: a base including a plurality of mounting brackets arranged along a first axis; a platform rotatably mounted to the base by a shaft and pivotable about a central axis of the shaft, the platform adapted to couple to a sight with a viewing aperture of the sight positioned at a first end of the platform; a bubble level coupled to the platform by a bubble level bracket and positioned at a second end of the platform, with the second end opposite to the first end in a direction parallel to the first axis; a range selector rotatably coupled to the base; a cartridge, comprising: a plurality of cams coupled to a first end of the cartridge, each cam of the plurality of cams sharing a same rotational axis with a cartridge central axis, and with each cam of the plurality of cams positioned coaxially along the rotational axis relative to each other; a first protrusion extending from an exterior surface of the cartridge and retractably coupled to the exterior surface; and an unlock button adapted as an actuator of the first protrusion and coupled to a second end of the cartridge, the second end positioned opposite to the first end; and a chamber formed by the range selector and adapted to receive the cartridge, comprising: a second protrusion extending from an interior surface of the chamber and retractably coupled to the interior surface. In a first example of the system for a sight mount, each cam of the plurality of cams includes at least one curved surface curving around the rotational axis, wherein the at least one curved surface of each cam couples to a corresponding flat surface, and wherein the at least one curved surface of each cam is curved differently than each other curved surface of each other cam. A second example of the system for a sight mount optionally includes the first example, and further includes wherein the plurality of cams includes only a first cam and a second cam, wherein the first cam includes a first flat surface, wherein the second cam includes a second flat surface, wherein the first flat surface and second flat surface are parallel to each other, and wherein the first flat surface and second flat surface are positioned away from the cartridge central axis. A third example of the system for a sight mount optionally includes one or both of the first and second examples, and further includes wherein the first flat surface is positioned away from the second flat surface in a direction perpendicular to the cartridge central axis. A fourth example of the system for a sight mount optionally includes one or more or each of the first through third examples, and further includes wherein the first flat surface and the second flat surface form a single flat surface shared by both of the first cam and the second cam. A fifth example of the system for a sight mount optionally includes one or more or each of the first through fourth examples, and further includes wherein the bubble level bracket is formed by the platform, and the bubble level bracket extends in a direction perpendicular to the first axis and away from the base, wherein a central axis of the bubble level is positioned perpendicular to the first axis and at an angle relative to the rotational axis, and wherein the bubble level is positioned vertically below the viewing aperture relative to the platform. A sixth example of the system for a sight mount optionally includes one or more or each of the first through fifth examples, and further includes wherein one or more edges of the bubble level bracket are chamfered or rounded, and wherein the bubble level is positioned vertically above a bracket first gap and vertically below a bracket second gap relative to the platform.

It will be appreciated that the configurations and routines disclosed herein are exemplary in nature, and that these specific embodiments are not to be considered in a limiting sense, because numerous variations are possible. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An article of manufacture, comprising:

a base having a cylindrical opening;

a cartridge rotatably mounted in the cylindrical opening and having a quick-release element and a cam surface; and a pivoting sight mount surface engaging the cam surface, wherein the cam surface is one of a plurality of cam surfaces, with the quick-release element positioned at an opposite end of the cartridge from the plurality of cam surfaces, with each cam surface of the plurality of cam surfaces being axially offset and adjacent one another, where at least one cam surface of the plurality of cam surfaces is not flat and curves continuously around a central axis of the cartridge, with the cylindrical opening formed by a chamber in the base that is open at both ends, and with the article further comprising a first biasing member urging the sight mount surface directly against the cam surface.

2. The article of claim 1, wherein the cam surface is any of a first cam surface, a second cam surface, a third cam surface, or a fourth cam surface of the plurality of cam surfaces, with a first cam comprising the first cam surface and the second cam surface, with a second cam comprising the third cam surface and the fourth cam surface, wherein the first cam surface and the third cam surface are each flat and without curvature, wherein the second cam surface and the fourth cam surface each curve continuously with a different curvature around the central axis of the cartridge relative to each other, with an end of the first cam parallel to an end of the second cam, with the end of the first cam and the end of the second cam perpendicular to the cam surface, with the end of the first cam bounded by the second cam surface and the end of the second cam bounded by the fourth cam surface, and wherein the second cam surface defines a gradual rotation of the sight mount surface by a first amount and the fourth cam surface defines a gradual rotation of the sight mount surface by a second amount.

3. The article of claim 1, wherein an unlock button of the quick-release element is coupled to a second biasing member disposed within an interior of the cartridge and surrounding a first shaft, the unlock button adapted to decouple the cartridge from the chamber via the first shaft, the cartridge slideable within the chamber along a central axis of the chamber from a first locked position to a second locked position, with a first cam of the cartridge engaged with the sight mount surface in the first locked position and a second cam of the cartridge engaged with the sight mount surface in the second locked position.

4. The article of claim 3, wherein a pivot in the base about which the sight mount surface pivots is positioned parallel to the central axis of the chamber at a downstream side along a projectile trajectory of a projectile sighted by a sight mounted to the sight mount surface.

5. The article of claim 3, wherein the quick-release element includes:

the unlock button positioned at a first end of the cartridge;

an indented surface positioned along an exterior surface of the cartridge, between the first end and a second end opposite the first end;

a third biasing member coupled to a second shaft, the second shaft positioned within the interior of the cartridge and perpendicular to the central axis of the cartridge, with the second shaft urged into an opening of the indented surface by the third biasing member; and the second biasing member coupled to the first shaft, with the first shaft positioned parallel to the central axis of the cartridge within the interior of the cartridge and urged directly against the unlock button by the second biasing member;

wherein a first surface of the first shaft is in direct contact with a second surface of the second shaft.

6. The article of claim 3, further comprising a first detent and a second detent positioned within an indented surface at an exterior surface of the cartridge, and a guide pin extending from an interior surface of the chamber and urged into the chamber by a third biasing member, with the guide pin adapted to couple with either of the first detent or the second detent.

7. The article of claim 1, further comprising:

a plurality of elongate channels positioned along an exterior surface of the cartridge and extending in a direction parallel to the central axis of the cartridge, wherein each elongate channel of the plurality of elongate channels has a first width in a direction around the exterior surface and the central axis of the cartridge; and a plurality of thin grooves within the exterior surface extending around the central axis of the cartridge, wherein each thin groove of the plurality of thin grooves has a second width in the direction parallel to the central axis of the cartridge, and wherein the second width is less than the first width.

8. The article of claim 3, further comprising:

an annular extension coupled to an exterior surface of the cartridge at a first end of the cartridge adjacent the quick-release element, the annular extension including a plurality of notches extending in a direction parallel to the central axis of the cartridge and positioned along an outer surface of the annular extension, and wherein a first midpoint of the annular extension and a second midpoint of the unlock button are each positioned along the central axis of the cartridge, and wherein the second midpoint is positioned between the first midpoint and a second end of the cartridge opposite the first end; and a guide slot formed by the exterior surface of the cartridge, the guide slot including a first opening with a first length positioned at the second end of the cartridge and a second opening with a second length formed by an indented surface of the exterior surface of the cartridge, with the first length being greater than the second length.

9. The article of claim 1, where the sight mount surface is a platform rotatably coupled to the base by a pivot pin and the first biasing member and adapted to pivot relative to the base along an axis of the pivot pin, the pivot pin positioned between a first end of the base and a second end of the base, with the platform including:

a first surface adapted to couple to a sight;

a second surface positioned opposite to the first surface in a direction toward the base; and a protrusion coupled to the second surface and extending away from the first surface, with the protrusion positioned between the first end second ends of the base, the protrusion engaging the cam surface;

wherein the cartridge is removably coupled to a range selector of the base, the cartridge including a plurality of cams positioned opposite to an unlock button along the central axis of the cartridge, with each cam of the plurality of cams being offset from the central axis of the cartridge in a radial direction of the central axis of the cartridge; and further comprising an open space formed between the second surface of the platform and the base, the plurality of cams positioned within the open space, with each cam of the plurality of cams adapted to be in face-sharing contact with the protrusion depending on an axial position of the cartridge within the chamber.

10. The system article of claim 1, wherein the cartridge includes a plurality of cams comprising the plurality of cam surfaces, with each cam of the plurality of cams extending away from the cartridge in a direction of the central axis of the cartridge from a first surface of the cartridge, and with each cam of the plurality of cams including a corresponding surface arranged parallel to the first surface of the cartridge and positioned away from the first surface of the cartridge in the direction of the central axis of the cartridge, and where the corresponding surface of each cam of the plurality of cams arranged parallel to the first surface of the cartridge is not in contact with any surface of the base or the sight mount surface.

11. The system article of claim 1, wherein the plurality of cam surfaces extends into an open space formed between the sight mount surface and the base, and wherein the at least one cam surface of the plurality of cam surfaces that is not flat and curves continuously around the central axis of the cartridge curves continuously in a direction away from the central axis of the cartridge.

12. The article of claim 1, wherein the cartridge includes a plurality of cams, the plurality of cams including a first cam joined to a first surface of the cartridge and extending away from the first surface of the cartridge in a direction of the central axis of the cartridge, and a second cam joined to the first cam and extending away from the first cam in the direction of the central axis of the cartridge, with the first cam positioned between the second cam and the first surface of the cartridge.

13. The article of claim 1, wherein the cartridge includes a plurality of cams, the plurality of cams comprising the plurality of cam surfaces, with each cam surface of the plurality of cam surfaces that is not flat and curves continuously around the central axis of the cartridge being coupled to a different, corresponding flat surface of a different, corresponding cam of the plurality of cams relative to each other cam surface of the plurality of cam surfaces that is not flat and curves continuously around the central axis of the cartridge.

14. The article of claim 1, wherein the plurality of cam surfaces includes a flat, first cam surface; a flat, second cam surface; a curved, third cam surface; and a curved, fourth cam surface, and wherein the cam surface engaging the pivoting sight mount surface is any of the first, second, third, and fourth cam surfaces.

15. The article of claim 1, wherein the cam surface engaging the sight mount surface is any of exactly four cam surfaces of the plurality of cam surfaces, the exactly four cam surfaces including a flat, first cam surface; a flat, second cam surface; a curved, third cam surface; and a curved, fourth cam surface, the first cam surface positioned parallel to the second cam surface, and the third cam surface and fourth cam surface each curving continuously around the central axis of the cartridge with a different curvature relative to each other.

16. The article of claim 1, further comprising a bubble level coupled to a bubble level bracket of the sight mount surface, where a leveling axis of the bubble level is parallel to the central axis of the cartridge.

17. The article of claim 1, further comprising:

a plurality of mounting brackets formed by the base and arranged along a first axis;

a bubble level bracket formed by the sight mount surface and positioned at a first end of the sight mount surface;

a bubble level coupled to the bubble level bracket, with a leveling axis of the bubble level positioned perpendicular to the first axis; and a sight coupled to the sight mount surface, with a viewing aperture of the sight positioned at a second end of the sight mount surface opposite to the first end of the sight mount surface.

18. The article of claim 1, further comprising a bubble level bracket formed by the sight mount surface, a bubble level coupled to the bubble level bracket, and a sight coupled to the sight mount surface, with the bubble level positioned vertically below a viewing aperture of the sight relative to the sight mount surface.

19. The article of claim 1, further comprising a bubble level bracket formed by the sight mount surface and a bubble level coupled to the bubble level bracket, with the bubble level bracket including one or more chamfered or rounded edges, and with the bubble level positioned vertically above a first gap of the bubble level bracket and vertically below a second gap of the bubble level bracket relative to the sight mount surface.

* * * * *